US009528257B2

(12) United States Patent
Hanifl et al.

(10) Patent No.: US 9,528,257 B2
(45) **Date of Patent: *Dec. 27, 2016**

(54) TOILET BOWL TRAPPING DEVICE

(71) Applicant: Sage Products, LLC, Cary, IL (US)

(72) Inventors: Paul Hanifl, Barrington Hills, IL (US); Jeff Steffens, Cary, IL (US); Tim Moran, Rockford, IL (US); David Beck, Cary, IL (US); Gregory T. Davis, Crystal Lake, IL (US)

(73) Assignee: SAGE PRODUCTS, LLC, Cary, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/843,660

(22) Filed: Sep. 2, 2015

(65) Prior Publication Data

US 2015/0376886 A1 Dec. 31, 2015

Related U.S. Application Data

(63) Continuation of application No. 13/526,191, filed on Jun. 18, 2012, now Pat. No. 9,157,224, which is a continuation-in-part of application No. 12/533,782, filed on Jul. 31, 2009, now Pat. No. 8,201,281.

(51) Int. Cl.

| | |
|---|---|
| ***E03D 11/00*** | (2006.01) |
| ***E03D 11/13*** | (2006.01) |
| ***E03C 1/264*** | (2006.01) |
| ***E03D 9/00*** | (2006.01) |

(52) U.S. Cl.

CPC ..... *E03D 11/13* (2013.01); *E03C 1/264* (2013.01); *E03D 9/00* (2013.01); *E03D 11/00* (2013.01)

(58) Field of Classification Search

CPC ..... E03D 9/00; E03D 11/00; E03D 11/13; E03C 1/264

USPC ..... 4/256.1

See application file for complete search history.

(56) References Cited

U.S. PATENT DOCUMENTS

| | | | |
|---|---|---|---|
| 561,576 | A | 6/1896 | Flannery |
| 733,102 | A | 7/1903 | Wilkinson |
| 875,973 | A | 1/1908 | Wood |
| 2,386,708 | A | 10/1945 | Morrison |
| 2,506,669 | A | 5/1950 | Heuacker |

(Continued)

OTHER PUBLICATIONS

Hall, K., et al. "Potty Talk from Japan", Businessweek, Jan. 2, 2007: 1-2 Downloaded http://www.bloomberg.com/bw/stories/2007-01-02/potty-talk-from-japanbusinessweek-business-news-stock-market-and-financial-advice.

(Continued)

*Primary Examiner* — Tuan N Nguyen
(74) *Attorney, Agent, or Firm* — Foley & Lardner LLP

(57) ABSTRACT

A trapping device for trapping non-dispersing cloths in a toilet bowl is disclosed. The trapping device comprises a strap and a plurality of hooks. The trapping device may be installed in a trapway of the toilet bowl. The strap has a first end, a second end, and a middle portion, wherein the first end includes a first tab extending perpendicular to the strap and the second end includes a second tab extending perpendicular to the strap, and the middle portion is rounded. The plurality of hooks extend from an inner wall of the strap. The strap is made of a strap material that is resilient to bend and springs back to its previous shape, such as a stainless steel or a high density polyethylene.

21 Claims, 19 Drawing Sheets

(56) References Cited

U.S. PATENT DOCUMENTS

| | | | |
|---|---|---|---|
| 2,691,172 | A | 10/1954 | Breslow |
| 2,693,603 | A | 11/1954 | Lehmann |
| 2,705,328 | A | 4/1955 | Felix |
| 2,785,561 | A | 3/1957 | Hoffman et al. |
| 2,811,724 | A | 11/1957 | Click et al. |
| 2,974,324 | A | 3/1961 | Lundelius |
| 3,393,408 | A | 7/1968 | Martin |
| 4,301,554 | A | 11/1981 | Wojcicki |
| 4,307,476 | A | 12/1981 | Halstad |
| 4,376,313 | A | 3/1983 | Morgan |
| 4,555,818 | A | 12/1985 | Harrington |
| 4,932,080 | A | 6/1990 | Pino |
| 5,027,447 | A | 7/1991 | Pino |
| 5,117,862 | A | 6/1992 | Molligan |
| 5,267,361 | A | 12/1993 | Lai |
| 5,546,614 | A | 8/1996 | King, II |
| 5,843,304 | A | 12/1998 | Marchesseault et al. |
| 6,668,389 | B1 | 12/2003 | Steinmetz et al. |
| 6,721,965 | B1 | 4/2004 | Alston |
| 6,802,085 | B2 | 10/2004 | Catanescu et al. |
| 7,096,516 | B1 | 8/2006 | Moore, Jr. et al. |
| 7,120,949 | B2 | 10/2006 | Wilburn |
| 7,150,050 | B2 | 12/2006 | Sharp |
| 7,383,594 | B1 | 6/2008 | Giesken et al. |
| 9,157,224 | B2 * | 10/2015 | Hanifl ..... E03D 11/00 4/256.1 |
| 2009/0113613 | A1 | 5/2009 | Kole |
| 2009/0271295 | A1 | 10/2009 | Hodge |
| 2011/0023219 | A1 | 2/2011 | Hanifl et al. |
| 2012/0154169 | A1 | 6/2012 | Hoekstra |
| 2013/0159143 | A1 | 6/2013 | Cheney et al. |
| 2013/0297459 | A1 | 11/2013 | Kiser et al. |
| 2014/0068486 | A1 | 3/2014 | Sellers et al. |

OTHER PUBLICATIONS

Oct. 28 , 2013—(PCT) International Search Report and Written Opinion—App PCT/US2013/046319.

Chen Tian et al., "Interactive design and presentation of ceramic sanitary products," Third International Conference on Virtual Reality and Its Application in Industry, vol. 4756, Apr. 4, 2003 (Apr. 4, 2003), pp. 259-264.

Tighe Joseph et al., "Finding Things: Image Parsing with Regions and Per-Exemplar Detectors", IEEE Computer Society Conference on Computer Vision and Pattern Recognition, Proceedngs, IEEE Computer Society, US, Jun. 23, 2013 (Jun. 23, 2013), pp. 3001-3008.

Aug. 25, 2015 (WO) International Search Report—App PCT/US2015/027888.

* cited by examiner

TOILET BOWL TRAPPING DEVICE

RELATED APPLICATIONS

This application is a continuation of Non-Provisional Application, U.S. Ser. No. 13/526,191, filed Jun. 18, 2012 which is a continuation-in-part application that claims priority to Non-Provisional Application, U.S. Ser. No. 12/533,782, filed Jul. 31, 2009 which is incorporated herein by reference in its entirety.

FIELD OF THE INVENTION

The present invention is directed towards a device for a toilet bowl, more specifically towards a trapping device for catching and retaining non-dispersing cloths in the toilet bowl.

BACKGROUND

Manufacturers produce disposable cloths used for personal cleaning, bathing, incontinence care, and disinfection. These cloths differ from other disposable hygiene products (such as toilet paper) in that they do not break down and disperse when in contact with water.

These non-dispersible cloths may be used in an environment where they are disposed of into a toilet. An accumulation of these cloths flushed down a toilet drain may eventually lead to a back up in the toilet, blockage of the wastewater drain system, malfunction of sewage pumps, accumulation in municipal sewers and wastewater treatment plants, or bursting of sewage pipes.

BRIEF SUMMARY OF THE INVENTION

The following presents a general summary of aspects of the invention in order to provide a basic understanding of at least some of its aspects. This summary is not intended as an extensive overview of the invention. It is not intended to identify key or critical elements of the invention or to delineate the scope of the invention. The following summary merely presents some concepts of the invention in a general form as a prelude to the more detailed description provided below.

In an aspect of the present invention, a trapping device for trapping non-dispersing cloths in a toilet bowl may comprise a strap and a plurality of hooks extending from an inner wall of the strap. The strap may include a first end, a second end, and a middle portion, wherein the first end includes a first tab extending perpendicular to the strap and the second end includes a second tab extending perpendicular to the strap, and the middle portion is rounded. The strap may be made of a strap material that is resilient to bend and spring back to its previous shape. The middle portion may include a polymer band located along a leading edge of a side of the middle portion. Additionally, when the trapping device is installed in a trapway of the toilet bowl, the polymer band may engage the bottom of the trapway of the toilet bowl. The first end may include a front tab that prevents the trapping device from being pushed down the toilet bowl. The strap material may be a stainless steel or a high density polyethylene. The trapping device may further include a retention band that extends around the periphery of the strap to hold the strap in a semi-compressed configuration defined by the first tab and the second tab partially separated with the first end and second end overlapping. The retention band may be made of a biodegradable material capable of being flushed in a toilet and/or a material that dissolves in water.

In another aspect of this invention, a trapping device for trapping non-dispersing cloths in a toilet bowl may comprise: a) a strap having a first end, a second end, and a middle portion, wherein the middle portion is rounded; b) a plurality of hooks extending from an inner wall of the strap; and c) a compression system configured to hold the strap in a rounded semi-compressed configuration and then release the strap to a rounded uncompressed configuration when installed in a toilet bowl such that the strap fits tightly within the toilet bowl. Furthermore, the compression system may include a first tab on the first end and a second tab on the second end, wherein the first tab and the second tab are configured to be held together in a rounded compressed configuration by a pliers, and further wherein the first tab and second tab are configured to be separated in the rounded semi-compressed configuration. Additionally, the compression system may further include a retention band that extends around the periphery of the strap to hold the strap in a semi-compressed configuration defined by the first tab and the second tab partially separated with the first end and second end overlapping. In an aspect of the invention, the retention band may be made of a biodegradable material capable of being flushed in a toilet. In another aspect of the invention, the retention band is made of a material that dissolves in water.

In an aspect of the invention, the first tab extends perpendicular from the first end of the strap and the second tab extends perpendicular from the second end of the strap.

In another aspect of the invention, the compression system may include a clasp system that holds the first end and the second end together in a rounded compressed configuration and releases the first end and second end when installed in the toilet bowl.

In yet another aspect of the invention, a method for trapping non-dispersing cloths in a toilet bowl, may include the following steps: 1) preparing a trapping device for installation, wherein the trapping device includes: a) a strap having a first end, a second end, and a middle portion, wherein the first end includes a first tab extending perpendicular to the strap and the second end includes a second tab extending perpendicular to the strap, and the middle portion is rounded; b) a plurality of hooks extending from an inner wall of the strap; and c) a retention band that extends around the periphery of the strap to hold the strap in a semi-compressed configuration defined by the first tab and the second tab partially separated with the first end and second end overlapping; 2) engaging the first tab and the second tab with a pair of pliers; 3) compressing the first tab and the second tab with the pair of pliers, wherein the compressing disengages the retention band from the strap of the trapping device; 4) removing the retention band from the strap of the trapping device; 5) using the pliers, setting the trapping device into the toilet bowl; and 6) releasing the tabs from the pliers, thereby expanding the strap of the trapping device in the toilet bowl to a rounded uncompressed configuration such that the strap fits tightly within the toilet bowl. In another aspect of the invention, the preparing of the trapping device for installation may ensure that the retention band is engaged with the strap and installed around the strap of the trapping device.

In yet another aspect of the invention, the method for trapping non-dispersing cloths in a toilet bowl may include the following additional steps: 7) engaging the first tab and the second tab with the pliers; 8) compressing the first tab and the second tab with the pliers, wherein the compressing disengages the trapping device from the toilet bowl, thereby allowing the trapping device to be removed from the toilet bowl; and 9) removing the trapping device from the toilet bowl with the pliers.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

The reader is advised that the attached drawings are not necessarily drawn to scale.

DETAILED DESCRIPTION OF THE INVENTION

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

Figure 4:
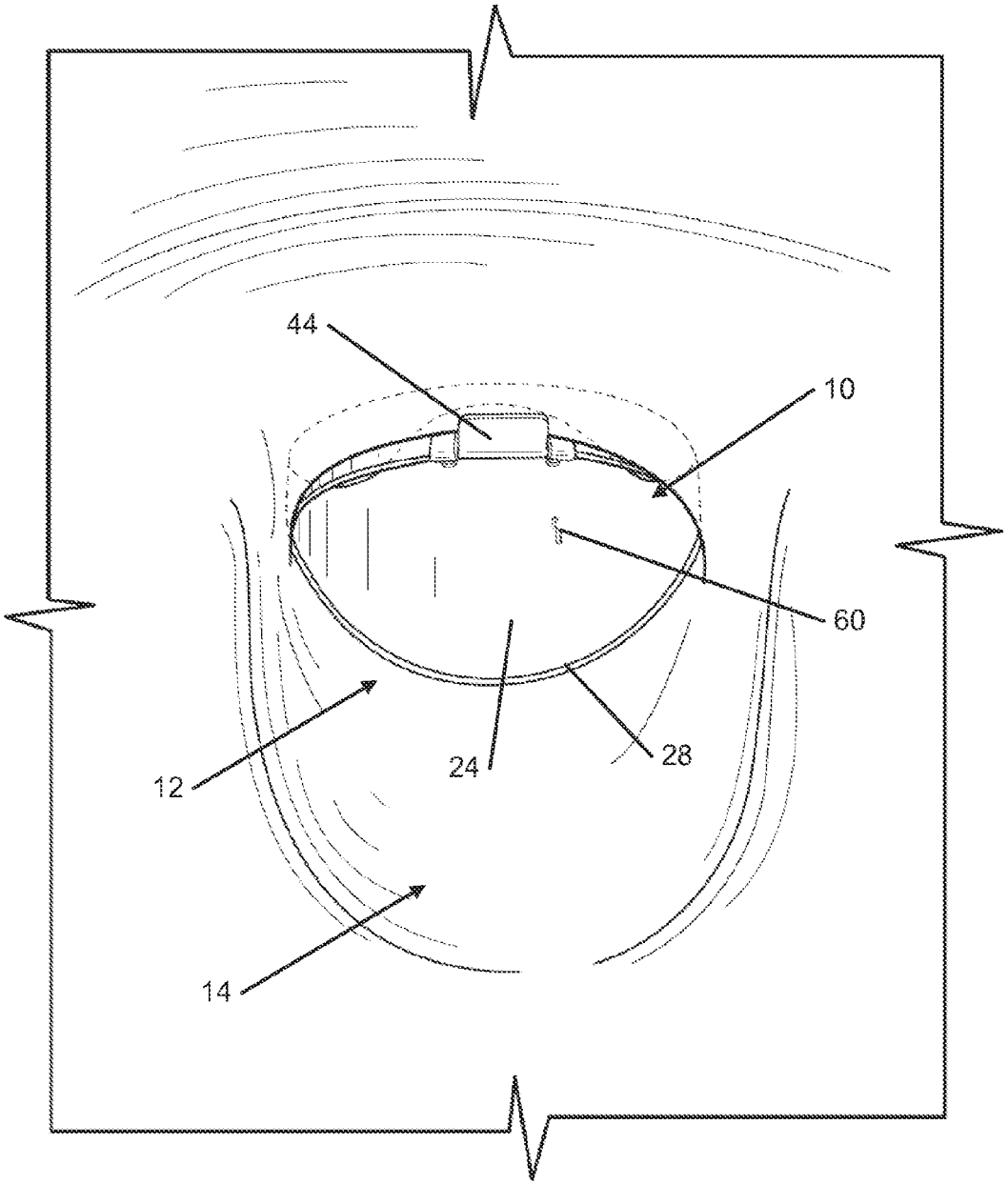
FIG. 4 illustrates a perspective view of the trapping device from FIG. 1A installed in a toilet bowl in accordance with this invention.
Figure 5:
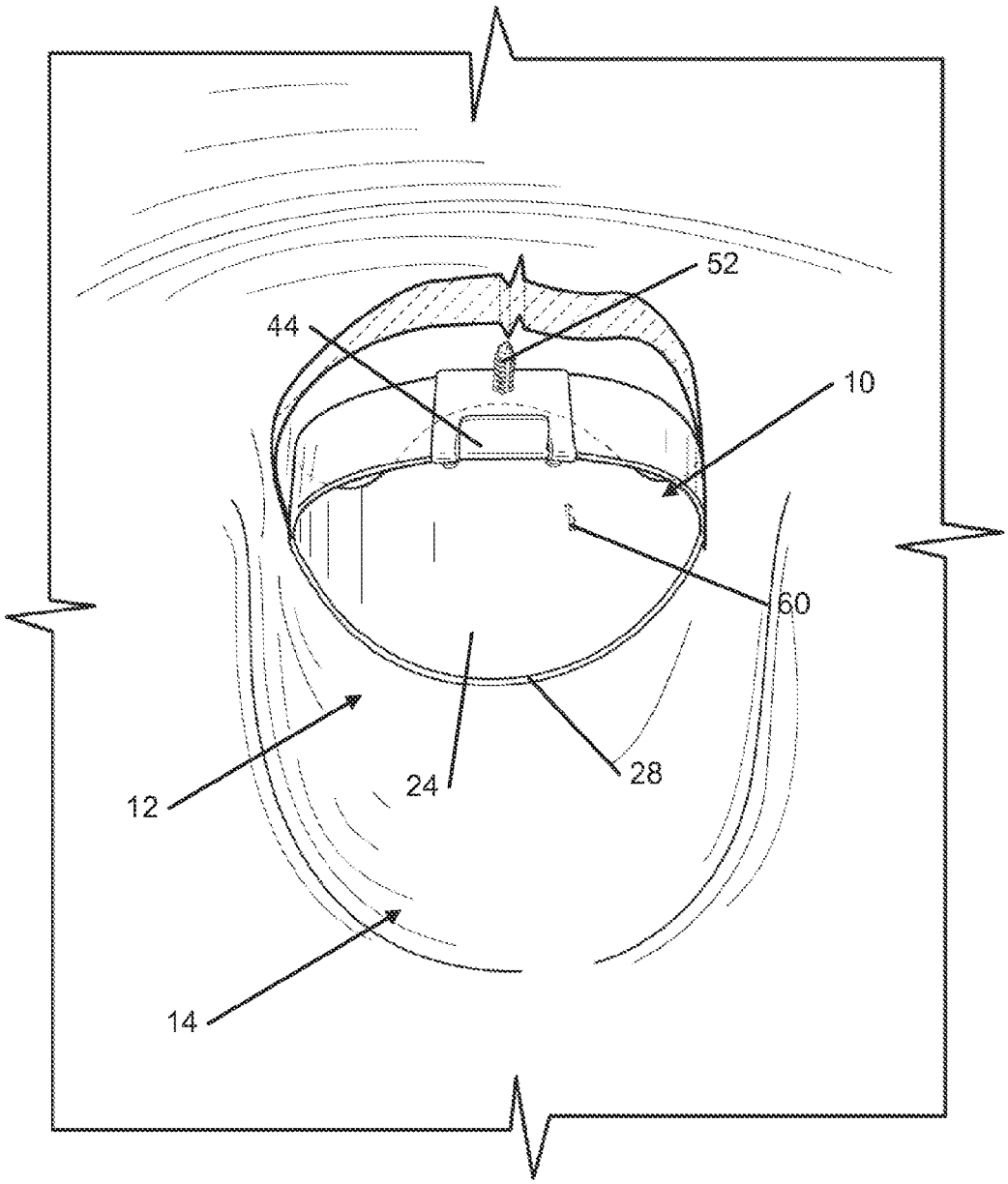
FIG. 5 illustrates a cut-out perspective view of the trapping device from FIG. 4 installed in the toilet bowl in accordance with this invention.

FIGS. 1A-3 illustrate a trapping device 10 for use in a toilet bowl 14 for trapping non-dispersing cloths. The trapping device 10 is comprised of a strap 20, an adjustment buckle 40, and a plurality of hooks 60. In one example in accordance with this invention, as illustrated in FIGS. 4 and 5 and discussed further below, the trapping device 10 is installed in a toilet bowl trapway 12 in the drain portion of the toilet bowl 14.

Figure 1A:
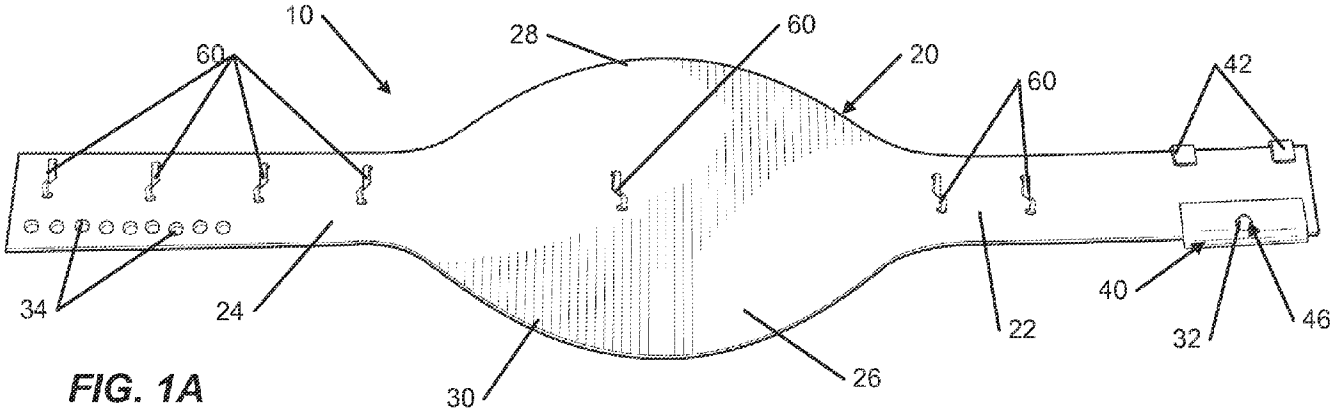
FIG. 1A illustrates a top plan view of the front side of an example trapping device in accordance with the present invention.
Figure 1B:
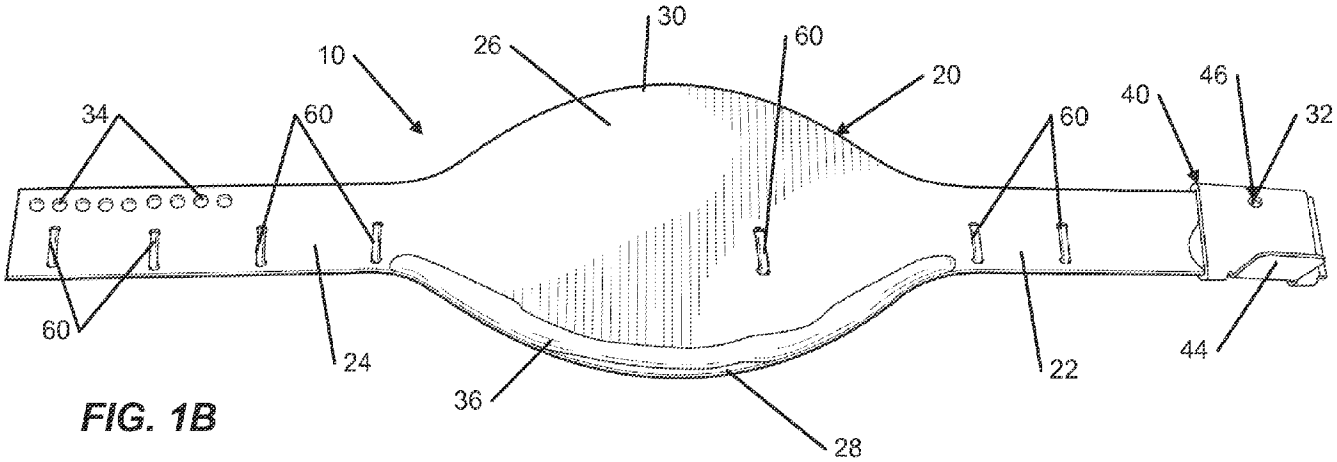
FIG. 1B illustrates a top plan view of the back side of the trapping device from FIG. 1A in accordance with this invention.
Figure 2A:
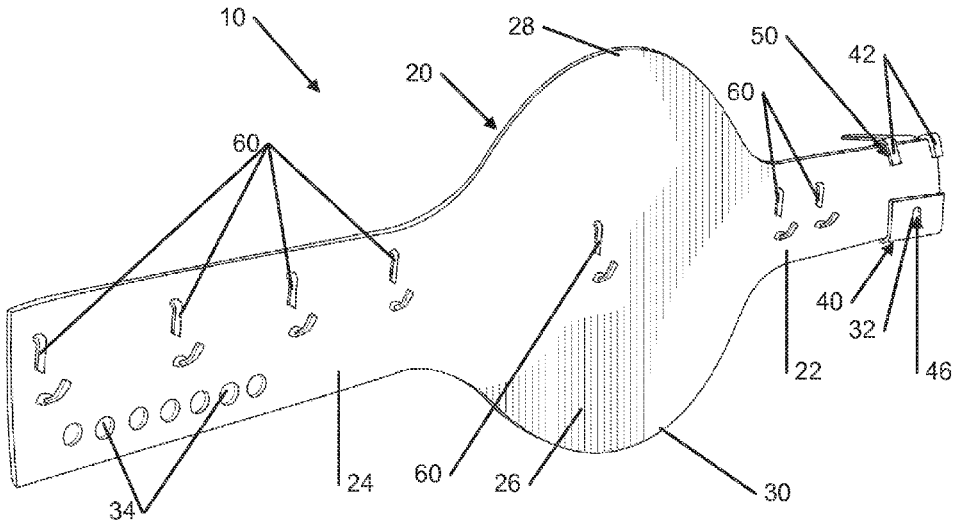
FIG. 2A illustrates a side perspective view of the front side of the trapping device from FIG. 1A in accordance with this invention.
Figure 2B:
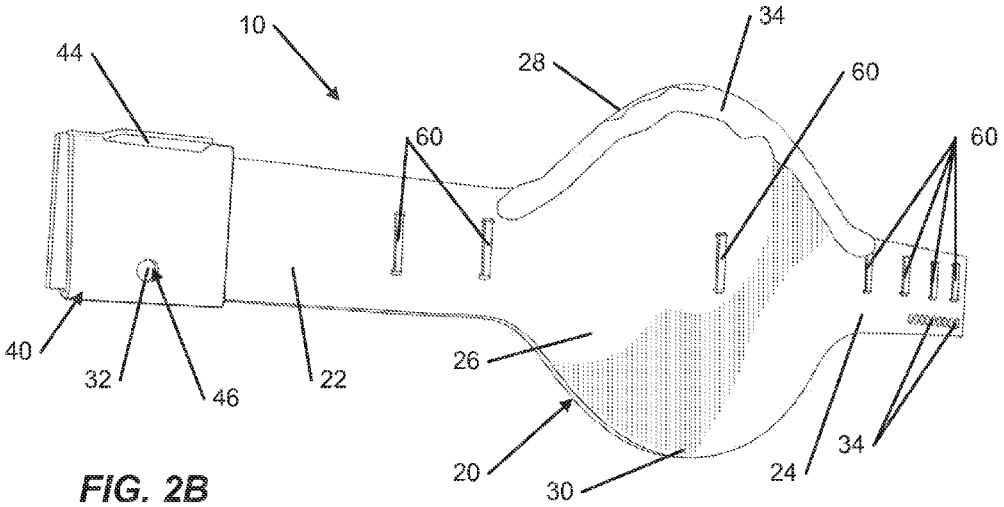
FIG. 2B illustrates a side perspective view of the back side of the trapping device from FIG. 1A in accordance with this invention.
Figure 3A:
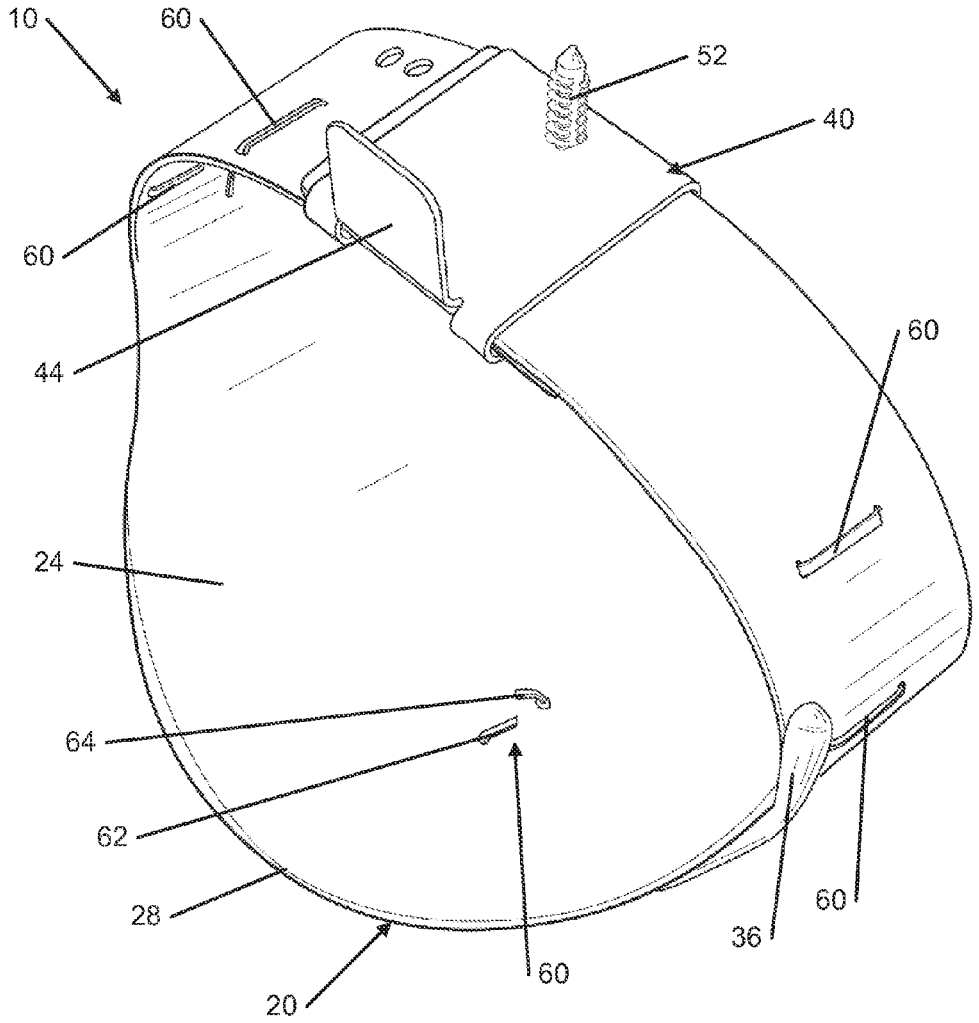
FIG. 3A illustrates a perspective view of the trapping device from FIG. 1A with both ends connected together in accordance with this invention.

As illustrated in FIGS. 1A-3A, the strap 20 may have a first end 22, a second end 24, and a middle portion 26 located in between the first end 22 and the second end 24. FIGS. 1A and 2A illustrate a top-view of the strap 20, while FIGS. 1B and 2B illustrate a bottom-view of the strap. FIG. 3A illustrates a view of the strap 20 with the ends 22, 24 connected together and prepared to be installed into the toilet bowl 14. The strap 20 has a leading edge 28 and a trailing edge 30 as illustrated in FIGS. 1A and 1B. The first end 22 and the second end 24 may be rectangular in shape, wherein the middle portion 26 may be many different shapes. In one example, as shown in FIGS. 1A and 1B, the middle portion 26 is rounded out on both the leading edge 28 and the trailing edge 30, such that the middle portion 26 may be somewhat similar to the shape of a football as can be seen in FIGS. 1A and 1B. The inventors have found that the rectangular shape for the first ends 22 and the second end 24 allow the flow of water through the toilet bowl 14 without obstructing the flow. The inventors have also found that the football shape middle portion 26 prevents the strap 20 and trapping device 10 from being sent down the drain of the toilet bowl 14 during routine operation. Additional shapes for the middle portion 26 are discussed later.

The strap 20 may be made of different materials without departing from the scope of the present invention. The strap material should allow the strap 20 to be able to fit within the various shapes of toilet bowls 14, yet also not fold or bend easily so that the strap 20 falls out of the trapway 12 of the toilet bowl 14. The strap 20 may be made of plastic, such as high density polyethylene (HDPE) to provide both strength and flexibility. Through testing by the inventor hereof, it has been found that using HDPE with a thickness between approximately 25-35 mil (0.025-0.035" thick) provides enough thickness to ensure that the trapping device 10 does not fold or bend easily, while also making the trapping device 10 thin enough to fit well within the majority of toilet bowl 14 configurations. In another exemplary embodiment, the strap may be approximately 30 mil HDPE. Alternatively, the strap 20 may be made of metal. While the strap 20 may be made of metal, some metals will corrode and rust when placed in a wet environment. The strap 20 may be made of a stainless steel that is non-corrosive in accordance with at least some examples of this invention.

The adjustment buckle 40 may be attached to the first end 22 of the strap 20 as will be discussed further below. Additionally, the first end 22 of the strap 20 includes a single hole 32. On the second end of the strap, there may be a plurality of adjustment holes 34. The cooperation of the adjustment buckle 40, the adjustment holes 34, and an adjustment connector 52 at the single hole 32 provides the user with the ability to adjust the diameter of the strap 20 to fit various sized toilet bowls 14, making the trapping device 10 adjustable and universal to various toilet bowls 14.

The middle portion 26 may also include a polymer band or strip 36 located along the leading edge 28 of one side, the under-side, of the middle portion 26. The band 36 may be made of a polymer substance or polymer bead, such as a hot-melt glue (e.g., 3M Jet melt adhesive, part#3764-AE). The band 36 may be in the shape of a narrow strip which extends along the leading edge 28 of the middle portion 26. The band 36 creates a seal between the trapping device 10 and the bottom of the toilet bowl 14, which diverts the water flow above and through the trapping device 10 rather than beneath the trapping device 10. The band 36 may be made of any similar substance or similar shape in accordance with examples of this invention as long as it diverts the water flow above and through the trapping device 10 rather than beneath the trapping device 10.

The adjustment buckle 40 may be attached to the first end 22 of the strap 20 by an epoxy or glue material bonding the strap 20 to the adjustment buckle 40. The adjustment buckle 40 may include a set of front guides 42, a front tab 44, an alignment hole 46 and an adjustment connector 52. The set of front guides 42 are located on the front side of the adjustment buckle 40 and may include one or more guides. The set of front guides 42 are bent 180 degrees from the adjustment buckle 40, thereby creating a slot 50 between the strap 20 and the adjustment buckle 40. When the adjustment buckle 40 is connected to the strap 20, the set of front guides 42 may be positioned such that the second end 24 of the strap 20 can slide through the slot 50. Additionally, the set of front guides 42 are sized such that the hooks 60 do not interfere with the adjustment buckle 40 when sliding the second end 24 of the strap 20 through the adjustment buckle 40 and while the hooks 60 are in an adjacent lateral position with the adjustment buckle 40. The front tab 44 may be located on the front side of the adjustment buckle 40 and may protrude from the adjustment buckle 40 perpendicularly. The alignment hole 46 is located on the adjustment buckle 40 on the side opposite the front tab 44. When the adjustment buckle 40 is installed on the strap 20, the alignment hole 46 lines up with one of the adjustment holes 34 on the second end 24 of the strap 20 to receive the adjustment connector 52. The adjustment connector 52 may be inserted through the alignment hole 46 on the adjustment buckle 40, one of the adjustment holes 34 on the second end 24 of the strap 20, and the single hole 32 on the first end 22 of the strap 20 when the first end 22 of the strap 20 is inserted into the adjustment buckle 40. The adjustment connector 52 may hold the adjusted size of the trapping device 10 in place. The adjustment connector 52 may be in the form of a rivet, a screw, or other connector in accordance with at least some examples of this invention.

The adjustment buckle 40 may be made of different materials without departing from the scope of the present invention. The adjustment buckle 40 should be made of a material that is non-corrosive so that the adjustment buckle 40 does not rust in the wet environment. Through testing, the inventors have found that 24-gauge 316 passivated stainless steel may be used as the material for the adjustment buckle 40. Additionally, other materials may be used for the material for the adjustment buckle 40 without departing from at least some examples of this invention, such as plastic or other non-corrosive metals.

Additionally, the adjustment connector 52 may be made of different materials without departing from the scope of the present invention. The adjustment connector 52 should also be made of a material that is non-corrosive so that the adjustment connector 52 does not rust in the wet environment. Through testing, the inventors have found that a plastic rivet may be used for the adjustment connector 52 (e.g., Pine-Tree Clip black, Thread Rite Screw Products, Part #M36 0300 02). Additionally, other materials, such as screws, pins, etc., may be used for the adjustment connector 52 without departing from at least some examples of this invention, such as stainless steel or other non-corrosive metals.

As shown in FIGS. 1A-3A, the plurality of hooks 60 are attached to the strap at various locations. The hooks 60 are used to catch and retain the non-dispersing cloths, while allowing other materials to pass by. The hooks 60 may be located on the first end 22 of the strap 20, the second end 24 of the strap 20, or middle portion 26 of the strap 20 or any combination thereof. Through testing by the inventor hereof, it has been found that the number, location, angle, and sharpness of the hooks 60 provides an optimal balance between catching the non-dispersing cloths, while allowing other materials to pass. The inventors have found that with too many hooks 60, the trapping device 10 then catches the non-dispersing cloths while also catching many of the undesirable toilet paper and waste. The inventors have also found that with using too few hooks 60, the trapping device 10 then does not catch all of or a significant percentage of the non-dispersing cloths. The inventors have found that the optimal number of hooks 60 to be installed on the strap 20 is between five and nine hooks 60, with less hooks 60 being used in the smaller version of the trapping device 10. In other embodiments in accordance with this invention, the number of hooks 60 can be outside the range of five to nine hooks. In an embodiment, at least five hooks are included. In another embodiment, no more than nine hooks 60 are included. In an alternative exemplary embodiment in accordance with this invention, the strap 20 may include seven hooks 60, with five or six hooks 60 being used in a smaller version of the trapping device 10. Additionally, in an embodiment, these hooks 60 may be located approximately an inch apart, with, for example, two hooks 60 located on the first end 22 of the strap 20, four hooks 60 located on the second end 24 of the strap 20, and one hook 60 located on the middle portion 26 of the strap 20, as shown in FIGS. 1A-2B. Additionally, the inventors have found that the hooks 60 may need to be forward enough, i.e. closer to the leading edge 28 of the strap 20, so that the non-dispersing cloths are visible to the user when the trapping device 10 is installed in the toilet bowl 14.

The angle of the hook 60 may also be important to catching and retaining the non-dispersing cloths while allowing other materials to pass. The inventors have found that the optimal angle for the hooks 60 is between approximately 45 and 60 degrees angled away from the strap 20 with the point of the hook 60 facing into the toilet bowl 14. When the hooks 60 are angled at 90 degrees, it was found that the cloths would catch and then fall off. In an embodiment in accordance with this invention, the angle of the hooks 60 is less than 90 degrees and greater than approximately 15 degrees. The number, location, and angle of the hooks 60 can vary without departing from at least some examples of this invention.

Figure 3B:
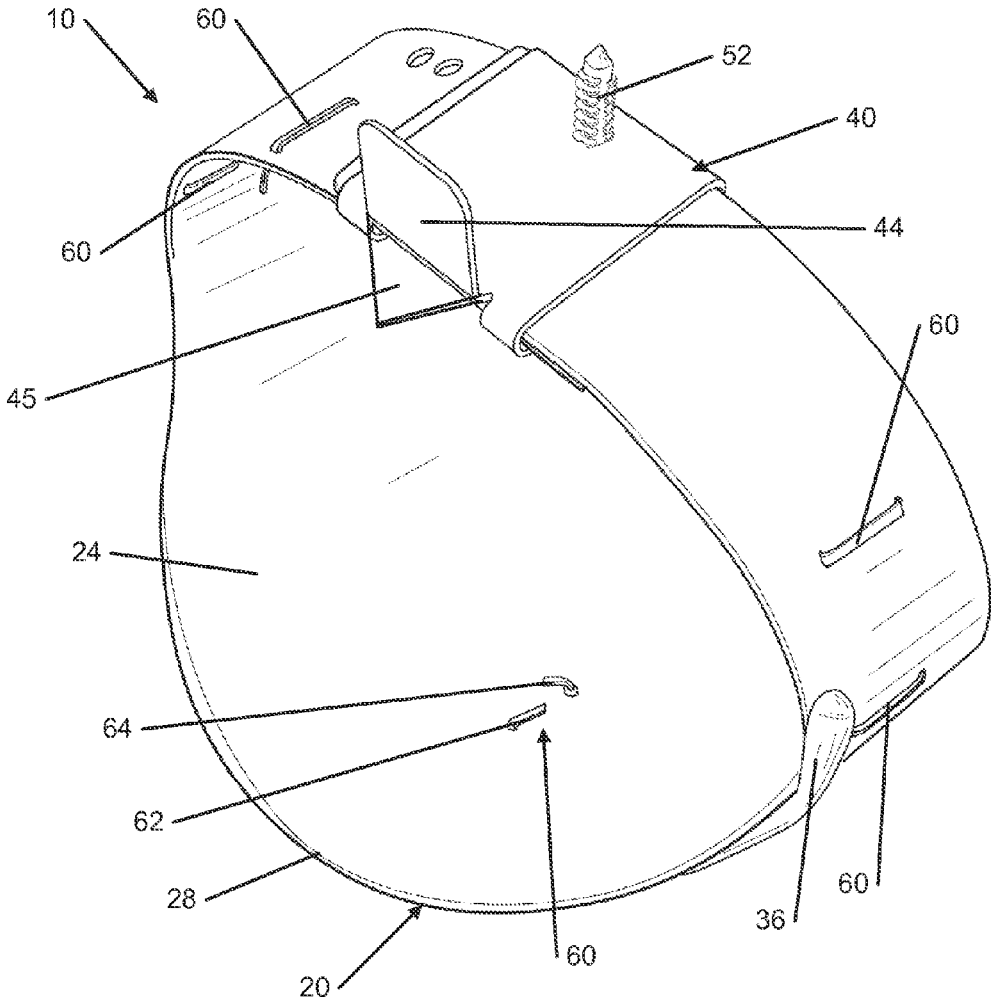
FIG. 3B illustrates a perspective view of the trapping device from FIG. 3A with a tooth in accordance with this invention.

The hooks 60 may be made of different materials without departing from the scope of the present invention. The hook material should be rigid and inflexible. The hook material should be able to remain substantially in position during toilet bowl cleaning, and if moved from position, go back into substantially the same position after the cleaning Additionally, the hook material should be a non-corrosive material so that the hooks 60 do not rust in the wet environment. Also, the hooks 60 may be sharp, such as sharp enough to catch the non-dispersing cloths, while being able to break or cut through the toilet paper and waste in the toilet 14. Additionally, barbed hooks 60 may be used without departing from at least some examples of the invention. The barbed hooks 60 may have a "T" barb to catch the non-dispersing cloths. Additionally, the adjustment buckle 40 may include a tooth 45 which acts as another hook, as illustrated in FIG. 3B. The tooth 45 may extend from either front or back of the adjustment buckle 40. The tooth 45 may be triangular shaped. This tooth-type hook 45 may be used to enhance the ability of capturing different types and weights of cloths. This tooth-type hook 45 may be different shapes or in different locations without departing from this invention. Through testing, the inventors have found that a heavy duty staple may be used as the hooks 60 (eg., Surebonder 5/16" stainless steel, No. 4, heavy duty, T50). When the heavy duty staple is used for the hooks 60, the staple may be inserted into the strap 20 from the back side of the strap 20, with a first leg 62 and a second leg 64 of the staple protruding out of the front side of the strap 20. The first leg 62 of the staple may be bent to lay flat against the front side of the strap 20, while the second leg 64 may be bent to an angle between 45-60 degrees. Additionally, other materials may be used for the hook 60 material without departing from at least some examples of this invention, such as Velcro, fishing hooks, and plastic hooks. Each of these examples may have their drawbacks, but could be found effective if used in combination or in different numbers.

The trapping device 10, as described above, may be installed in a toilet 14 by a user. To install the trapping device 10, the user may first prepare the trapping device 10 for installation, as shown in FIG. 3A. To prepare the trapping device 10 for installation, the user may first insert the second end 24 of the strap 20 with the plurality of adjustable holes 34 into the slots 50 provided between the two front guides 42 of the adjustment buckle 40 and the first end 22 of the strap 20. The slots 50 on the back side of the strap 20 receive the second end 24 of the strap 20 which allows for size adjustment based on the size of the toilet bowl trapway 12. Because the size of toilets 14 vary, the user may size the trapping device 10 to properly fit the trapping device 10 into the toilet bowl trapway 12. Once the two ends 22, 24 of the strap 20 are adjusted to fit the toilet bowl trapway 12, the adjustment connector or rivet 52 may be inserted through the adjustment buckle 40, the single alignment hole 32, and the selected adjustment hole 34 on the second end 24 of the strap 20 to hold the adjusted size in place. The trapping device 10 as shown in FIG. 3A is prepared for installation into the toilet bowl 14.

Figure 10:
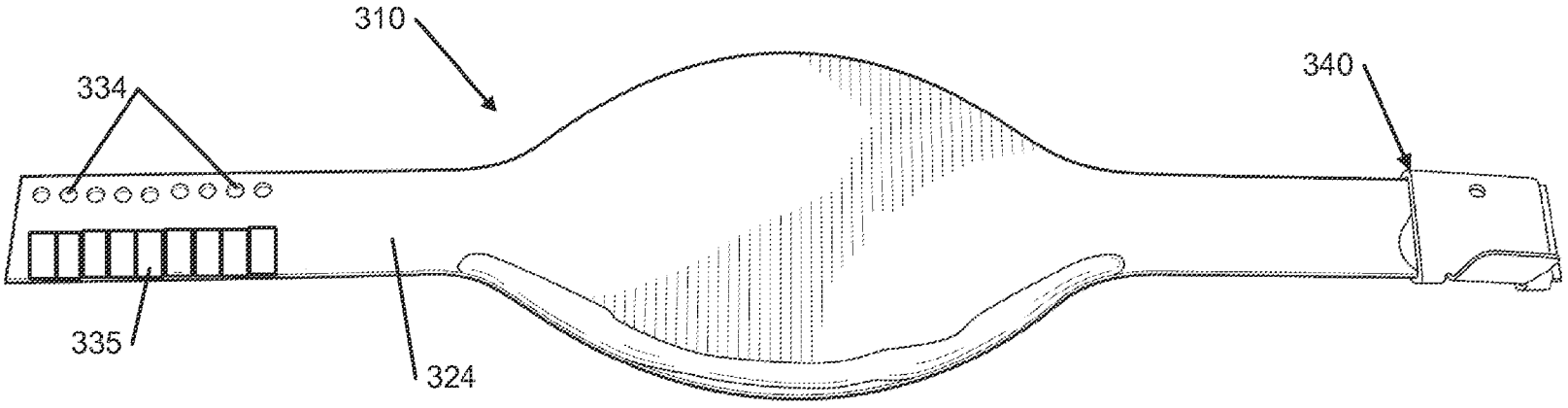
FIG. 10 illustrates a top plan view of an example sizing tool in accordance with this invention.

As illustrated in FIG. 10, when installing the trapping device 10 into the toilet bowl trapway, the user may first use a sizing tool 310. The sizing tool 310 is similar to the trapping device 10 as described above, without the hooks 60. The sizing tool 310 may include colors strips 335 that consist of multiple distinct colors that match up with each of the adjustment holes 334. The user may place the sizing tool 310 into the toilet bowl trapway 12 and expand the strap of the sizing tool fully in the drain by sliding the end of the strap 324 through the adjustment buckle 340. The user may then note the color 335 indicated on the sizing tool 310. The color 335 indicated on the sizing tool 310 may then correspond to an adjustment hole 34 on the trapping device 10, thus allowing the user to install the trapping device 10 into the trapway. This sizing tool 310 may be used with the installation of the trapping device 10, however, this sizing tool 310 is not required for the installation of the trapping device 10.

As illustrated in FIGS. 4 and 5, the user may install the trapping device 10 into the toilet bowl trapway 12. To install the trapping device 10 into the toilet bowl trapway 12, the user may first set the trapping device 10 at an angle with the top of the rivet 52 under the top side of the toilet bowl trapway 12. The user may then slide the trailing edge 30 of the middle portion 26 of the strap 20 into the bottom of the toilet bowl trapway 12. The band 36 on the under-side of the middle portion 26 of the strap 20 may create a seal with the bottom of the toilet bowl trapway 12, thereby helping water to flow over the trapping device 10, rather than under the trapping device 10. When the band 36 is seated against the bottom of the toilet bowl trapway 12, the front tab 44 is seated against the front portion of the top side of the toilet bowl trapway 12. With the front tab 44 seated in this location on the toilet bowl trapway 12, the trapping device 10 is prevented from being pushed into the drain during normal toilet bowl operations, such as flushing, and normal toilet bowl cleaning. Additionally, the shape of the middle portion 26 of the strap 20, the general football shape, helps prevent the trapping device 10 from being pushed down the drain during normal toilet bowl operations, such as flushing, and normal toilet bowl cleaning. The combination of the rivet 52, the front tab 44, and the shape of the middle portion 26 all help to keep the trapping device 10 in the proper location throughout the entire flushing process, with water exiting through the drain and water flowing upward after the flush to fill the toilet bowl 14. As illustrated in FIGS. 4 and 5, the leading edge 28 of the strap 20 may be the only part of the trapping device 10 that the user can see when the trapping device 10 is installed in the toilet bowl 14.

Additionally, as illustrated in FIGS. 4 and 5, the majority of hooks 60 may be located on the top and the sides of the installed trapping device 10. The hooks 60 may be located in this location so that they do not interfere with human waste. The single hook 60 on the bottom of the installed trapping device 10 is located on the bottom to prevent heavy cloths from slipping by the top hooks 60. Because of the weight, these heavy cloths are more capable of dropping to the bottom of the toilet bowl trapway 12 during the flushing, and thereby may be caught by the bottom hook 60 in the middle portion 26.

The color of the trapping device 10 has been found to be important when installed in the toilet bowl 14. Through testing, the inventors have found that a strap 20 with a color in contrast with the non-dispersing clothes is useful. For example, a black strap 20 contrasts with the caught white non-dispersing clothes for the user, who may be responsible for removing the caught cloths from the trapping device 10. The inventors found when using white plastic for the strap 20, the white strap 10 does not contrast enough with the white non-dispersible cloths and the white toilet bowl 14 and therefore it was hard to differentiate the caught cloths from the trapping device 10. Other colors may be used for the trapping device 10 or the strap 20 without departing from at least some examples of this invention, as long as the color contrasts with the white non-dispersible cloths.

Additionally, the user may utilize a disposable retrieval hook to retrieve the cloths that have been caught by the trapping device 10. The retrieval hook may be a metal or plastic hook designed to retrieve cloths from the trapping device 10.

Once installed, the trapping device 10 can also be removed from the toilet bowl 14. The user may need to use pliers or a similar tool to remove the trapping device 10 from the toilet bowl trapway 12 because of the close fit and the combination of the rivet 52 and the front tab 44 fit with the top of the toilet bowl trapway 12. Additionally, the trapping device 10 may be semi-permanently installed in the toilet bowl 14. This semi-permanent installation may be accomplished by using epoxy or cement or some other glue material without departing from the scope of this invention.

Figure 6A:
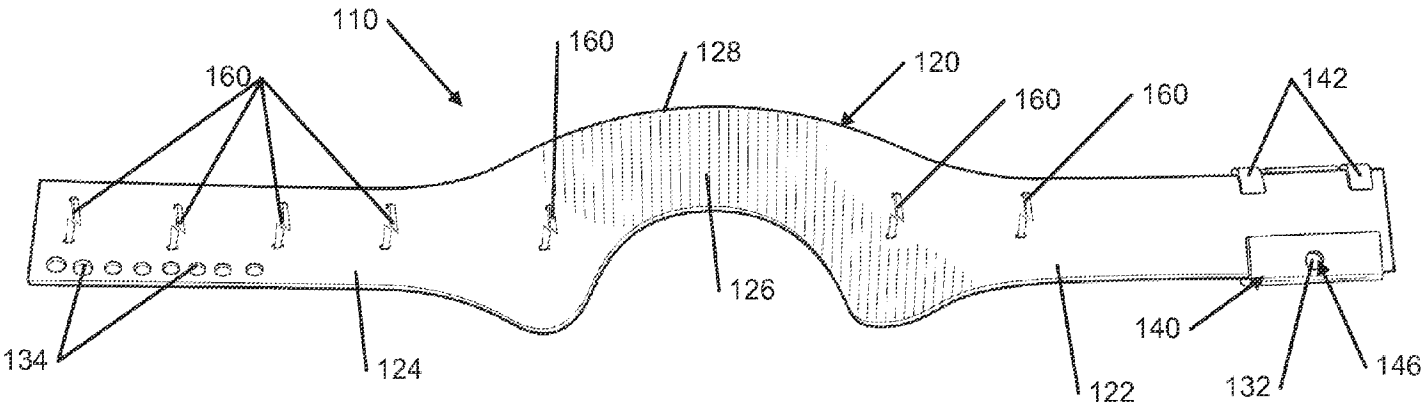
FIG. 6A illustrates a top plan view of the front side of an example trapping device for use in a toilet bowl with a jet-assist housing in accordance with the present invention.
Figure 6B:
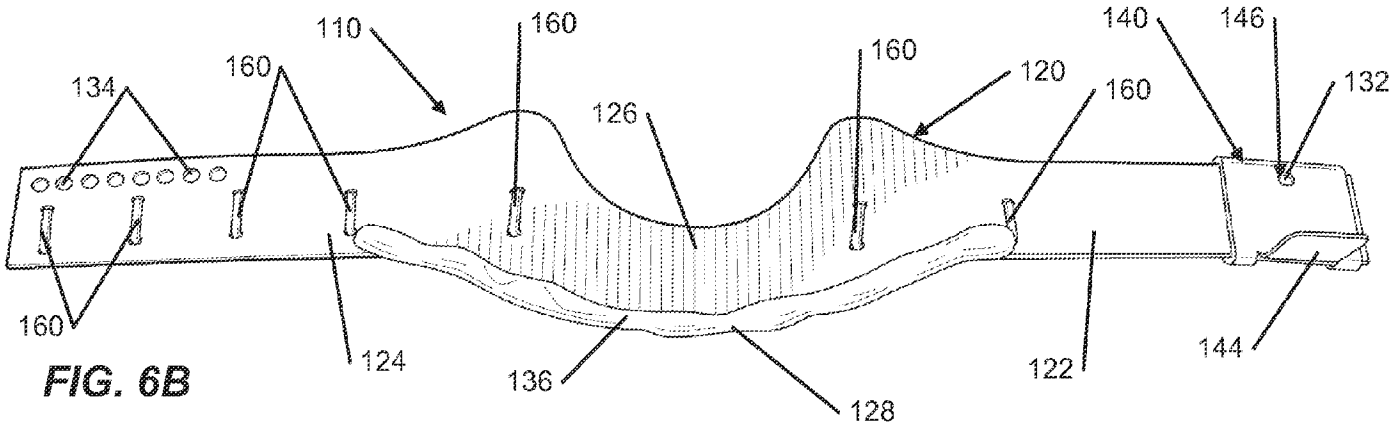
FIG. 6B illustrates a top plan view of the back side of the trapping device from FIG. 6A in accordance with this invention.
Figure 7:
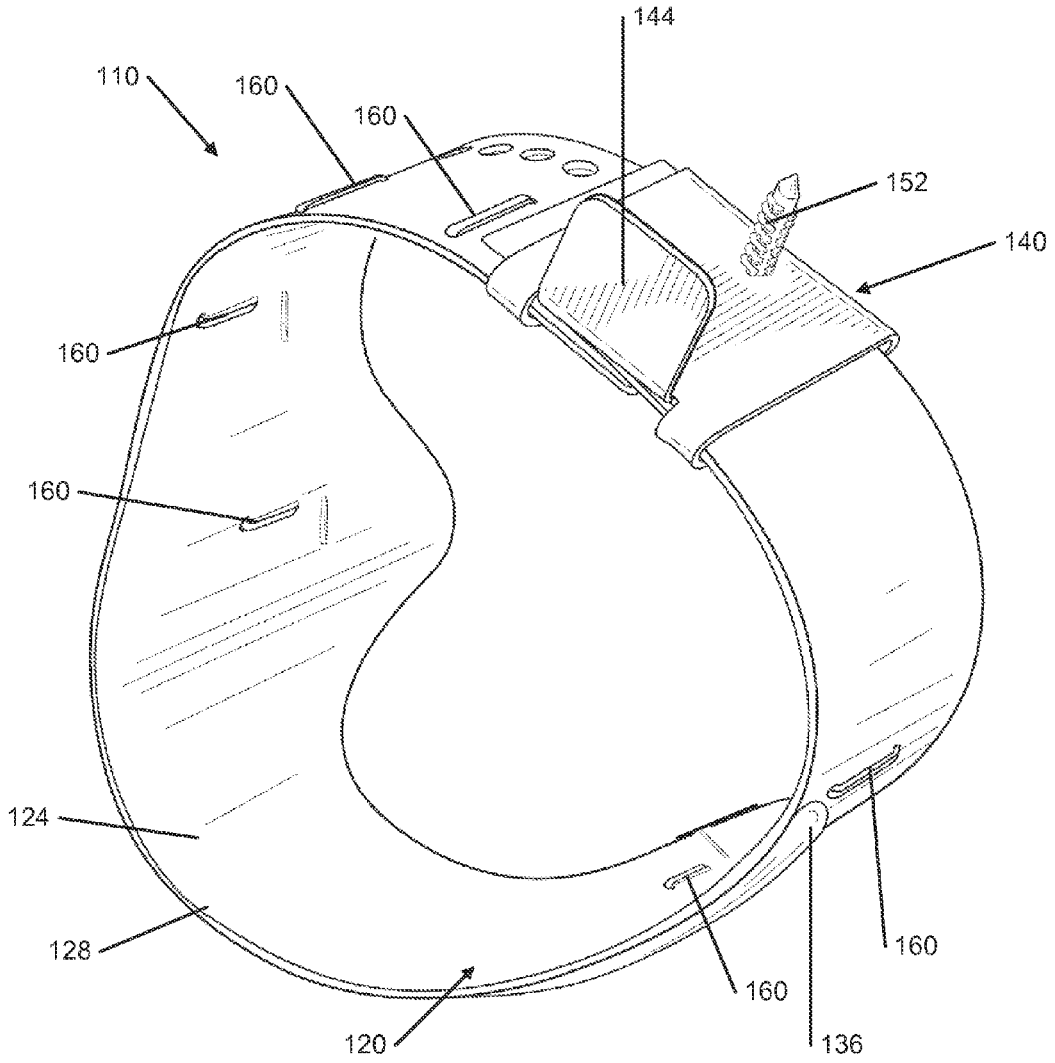
FIG. 7 illustrates a perspective view of the trapping device from FIG. 6A with both ends connected together in accordance with this invention.
Figure 8:
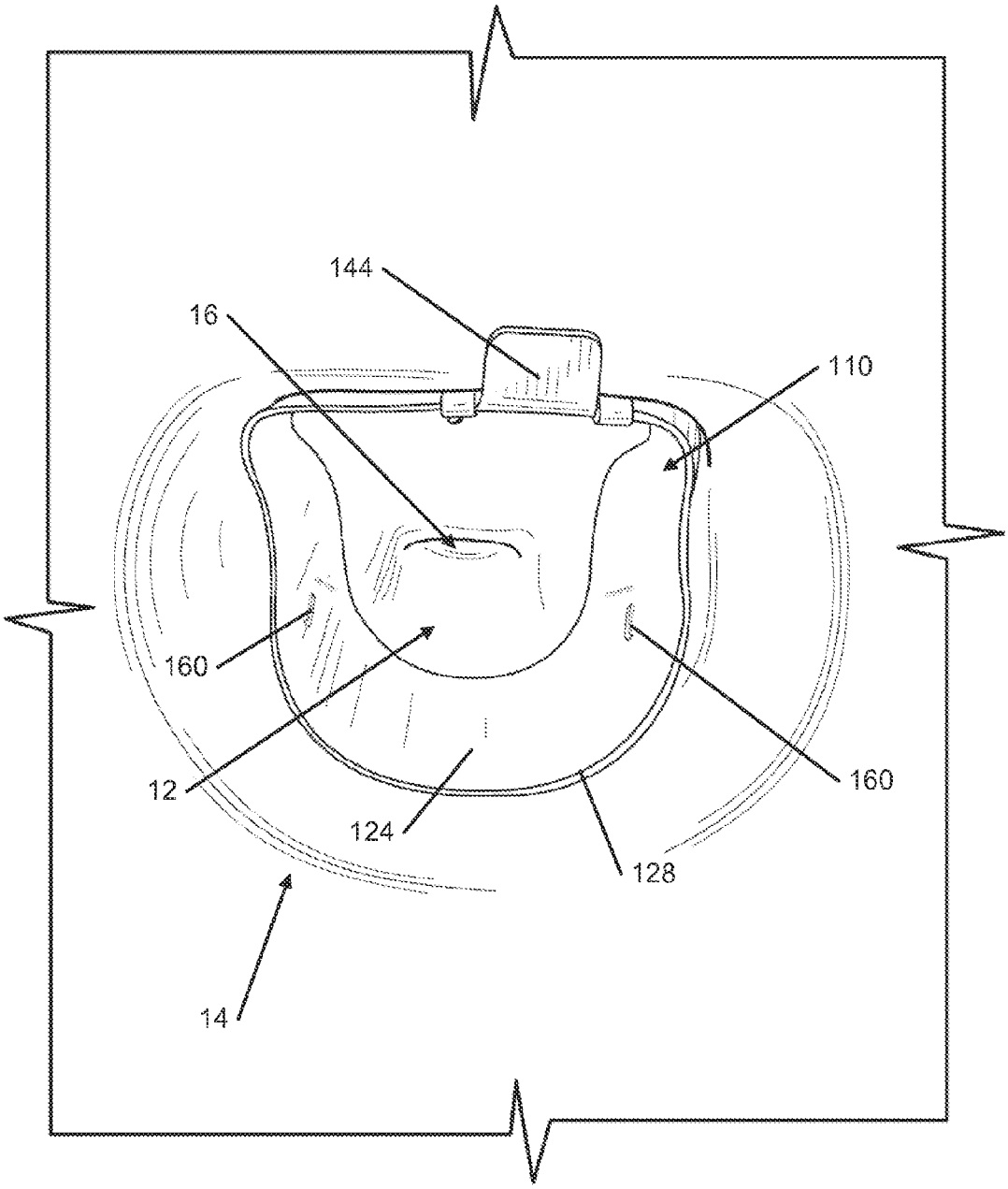
FIG. 8 illustrates a perspective view of the trapping device from FIG. 6A installed in a toilet bowl in accordance with this invention.

FIGS. 6A-8 illustrate an example combination according to this invention similar to that described above in conjunction with FIGS. 1A-5 (the same or similar reference numbers are used in FIGS. 6A-8 as those used in FIGS. 1A through 5 to denote the same or similar parts). FIGS. 6A-8 illustrate a trapping device 110 for a toilet bowl with a "jet-assist" housing 16 near the toilet bowl trapway 12. The jet-assist propels water into the trapway 12 to aid in clearing the toilet bowl 14. As FIGS. 6A-8 illustrate, the jet-assist trapping device 110 may have a section from the middle portion 126 that is cut away to accommodate the jet-assist housing 16. Additionally, the location of the hooks 160 may be slightly different because of the smaller middle portion 126. Similar to the trapping device 110 described above, the hooks 160 may be located approximately an inch apart, with one hook 160 located on the first end 122 of the strap 120, four hooks 160 located on the second end 124 of the strap 120, and two hooks 160 located on the middle portion 126 of the strap 120, as illustrated in FIGS. 6A and 6B. The two hooks 160 located on the middle portion 126 may be located on the middle portion 126 next to where the jet-assist housing 16 is located. The number, location, and angle of the hooks 160 on the strap 120 can vary without departing from at least some examples of this invention.

Figure 9A:
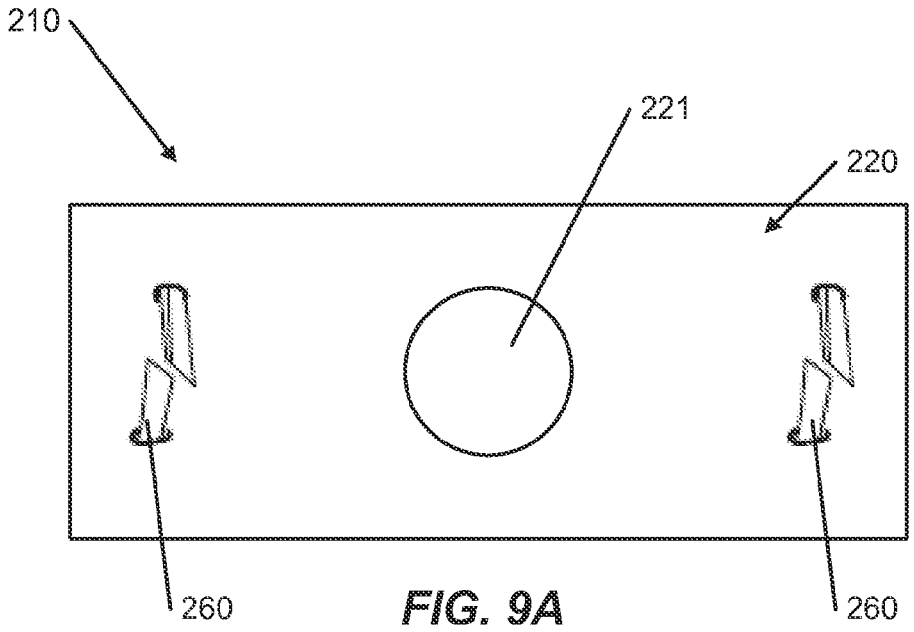
FIGS. 9A and 9B illustrate a top plan view of an example trapping device for use in a toilet bowl.
Figure 9B:
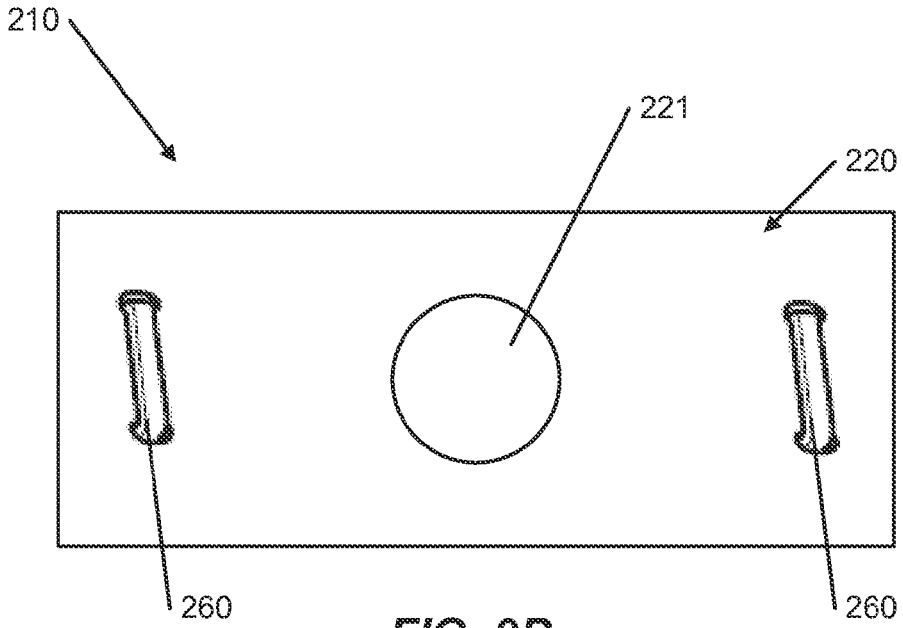

FIGS. 9A and 9B illustrate an example combination according to this invention similar to that described above in conjunction with FIGS. 1A-5 (the same or similar reference numbers are used in FIGS. 9 and 10 as those used in FIGS. 1A through 5 to denote the same or similar parts). FIG. 9A illustrates a front-view of a glue-in trapping device 210 for use in a toilet bowl 14. FIG. 9B illustrates a back-view of the glue-in trapping device 210. The glue-in trapping device 210 includes a mini-strap 220 and at least one hook 260. Each mini-strap 220 may be rectangular in shape with a hole 221 in the middle of the mini-strap 220. On each side of the hole 221, there may be two hooks 260 positioned vertically along the mini-strap 220. In this example, multiple mini-straps 220 may be installed in the toilet bowl trapway 12.

As shown in FIGS. 9A and 9B, the mini-strap 220 may be rectangular in shape and may be approximately ½"×1¼". The mini-strap 220 may be made of a number of different materials without departing from the scope of the present invention. The mini-straps 220 may be made of plastic, such as 30 mil HDPE to provide both strength and flexibility. Alternatively, the mini-straps 220 may also be made of metal. While the mini-strap 220 may be made of metal, some metals will corrode and rust when placed in a wet environment. The mini-strap 220 may be made of a stainless steel that may be non-corrosive in accordance with at least some examples of this invention. The hole 221 may be located in the center of the mini-strap 220 and aids in affixing the mini-strap 220 to the toilet bowl 14. The hole 221 may be approximately ¼" in diameter. The mini-strap 220 and hole 221 may be different shapes and sizes without departing from the scope of the present invention.

Additionally, as shown in FIGS. 9A and 9B, the mini-strap 220 may include at least one hook 260. The mini-strap 220 illustrated in FIG. 9 has two hooks 260, one on each side of the mini-strap 220. As was described above, the hooks 260 are used to catch and retain the non-dispersible cloths, while allowing other materials to pass by. The optimal angle for the hooks 260 is between approximately 45 and 60 degrees from the mini-strap 220 with the point of the hook 220 facing into the toilet bowl 14. The number, location, and angle of the hooks 260 can vary without departing from at least some examples of this invention.

As described above for FIGS. 1A-5, the hooks 260 may be made of a number of different materials without departing from the scope of the present invention. The hook material must be rigid and inflexible. Additionally, the hook material should be a non-corrosive material so that the hooks 260 do not rust in the wet environment. Also, the hooks 260 may be sharp, such as sharp enough to catch the non-dispersing cloths, while breaking or cutting through the toilet paper and waste in the toilet 14. Additionally, barbed hooks 260 may be used without departing from at least some examples of the invention. The barbed hooks 260 may have a "T" barb to catch the non-dispersing cloths. Through testing, the inventors have found that a heavy duty staple may be used for the hooks 260 (eg., Surebonder 5/16" stainless steel, No. 4, heavy duty, T50). Additionally, other materials may be used for the hooks 260 without departing from at least some examples of this invention, such as Velcro, fishing hooks, and plastic hooks. Each of these examples may have their drawbacks, but could be found effective if used in combination or in different numbers.

When installing the glue-in trapping device 210 as described above, the user places and holds the mini-strap 220 in a preferred location. The hole 221 in the mini-strap 220 allows for the epoxy to be squeezed through the mini-strap 220 when pressed against the toilet bowl 14 and flattened against the other side. This epoxy may form an epoxy "rivet"/head that holds the mini-strap 220 and the hooks 260 securely in place on the toilet bowl 14. The toilet bowl 14 should be completely dry to stick the epoxy. The epoxy may be an underwater epoxy, thereby allowing the epoxy to dry underwater and allowing for a quick installation and quick return to use for the toilet bowl 14. There may be four mini-straps 220 affixed to the top and sides of the toilet bowl trapway 12 and one additional mini-strap 220 may be affixed to the bottom of the trapway 12 for reasons as discussed above. Additionally, depending on the size of the toilet bowl 14, the number of mini-straps 220 can increase or decrease without departing from at least some examples of this invention. Additionally, a "mini-strap" mounting peg may be permanently attached, wherein the removable "mini-strap" may be affixed to the mounting pegs and changed out or replaced if damaged.

In another example trapping device 10 according to aspects of this invention, the strap 20 and the trapping device 10 as discussed above and illustrated in FIGS. 1A-5 may be built into the toilet 14 itself. For example, during the manufacturing process of the toilet bowl 14, the strap 20 and the trapping device 10 may be installed within the ceramic of the toilet bowl 14, thereby making the strap 20 and the trapping device 10 a permanent fixture of the toilet bowl 14.

In another example trapping device 10 according to aspects of this invention, the hooks 60 may be installed or formed integral to the toilet bowl 14. For example, during the manufacturing process of the toilet bowl 14, a plurality of hooks 60 may be singularly installed within the ceramic of the toilet bowl 14, thereby making the hooks 60 a permanent fixture of the toilet bowl 14. The location and number of hooks 60 may be similar to those as discussed above for FIGS. 1A-5. There may be approximately 5 to 6 hooks 60 spaced approximately 1" apart and located on the upper and side portions of the toilet bowl trapway 12, with one additional hook 60 located on the bottom of the toilet bowl trapway 12. In this example, the hooks 60 may be made of the same materials as discussed above or may be made of a material similar to or the same as the material of the toilet bowl.

FIGS. 11-14 illustrate another example embodiment according to this invention similar to that described above in conjunction with FIGS. 1A-5 (the same or similar reference numbers are used in FIGS. 11 through 14 as those used in FIGS. 1A through 5 to denote the same or similar parts).

FIGS. 11-14 illustrate a trapping device 410 for use in a toilet bowl 14 for trapping non-dispersing cloths. The trapping device 410 is comprised of a strap 420, a compression system 480, and a plurality of hooks 460. In one example in accordance with this invention, as illustrated in FIGS. 11-14 and discussed further below, the trapping device 410 is installed in a toilet bowl trapway 12 in the drain portion of the toilet bowl 14.

As illustrated in FIGS. 11-14, the strap 420 may have a first end 422, a second end 424, and a middle portion 426 located in between the first end 422 and the second end 424. FIGS. 11-14 illustrate a top-view of the strap 420, while FIGS. 11-14 illustrate a bottom-view of the strap 420. The strap 420 has a leading edge 428 and a trailing edge 430 as illustrated in FIGS. 11-14. The first end 422 and the second end 424 may be rectangular in shape, wherein the middle portion 426 may be many different shapes. In one example, as shown in FIGS. 11-14, the middle portion 426 is rounded out on both the leading edge 428 and the trailing edge 430, such that the middle portion 426 may be somewhat similar to the shape of a football as can be seen in FIGS. 11-14. Additional shapes for the middle portion 426 are discussed later.

The strap 420 may be made of different materials without departing from the scope of the present invention. First, the strap material should be resilient enough to bend and spring back to the previous shape. The strap material should allow the strap 420 to fit within the various shapes of toilet bowls 14, yet also not fold or bend easily so that the strap 420 falls out of the trapway 12 of the toilet bowl 14. The strap 420 may be made of plastic, such as high density polyethylene (HDPE) to provide both strength and flexibility. Alternatively, the strap 420 may be made of a resilient metal, such as a stainless steel. Other metals maybe utilized without departing from this invention. While the strap 420 may be made of metal, some metals will corrode and rust when placed in a wet environment. The strap 420 may be made of a stainless steel that is non-corrosive in accordance with at least some examples of this invention.

The compression system 480 may be utilized to hold the trapping device 410 together during installation and then release the trapping device 410 when installed in the toilet bowl 14. The compression system 480 may first compress the trapping device 410 in order to install the trapping device 410 in a toilet bowl 12. Secondly, then the compression system 480 may uncompress, expand, and/or release the trapping device 410 once installed in the toilet bowl 14 to ensure the trapping device 410 remains installed in the toilet bowl 12. Many different compression systems may be utilized without departing from this invention. One compression system 480, as illustrated in FIGS. 11-14, utilizes a pair of tabs 482 and a retention band 484. The pair of tabs 482 may include a first tab 482A and a second tab 482B. The first tab 482A may be located on the first end 422 of the strap 420 extending perpendicular to the strap 420 and extending inwards toward the center of the strap 420. The second tab 482B may be located on the second end 422 of the strap 420 extending perpendicular to the strap 420 and extending inwards towards the center of the strap 420. The tabs 480 may be generally sized and shaped such that a tool or pliers can grasp and/or hold the tabs together during the installation process, which will be explained in more detail below.

Additionally, as illustrated in FIGS. 11-14, the compression system 480 may include a retention band 484. The retention band 484 may be a band that holds the trapping device 410 in a semi-compressed configuration, as specifically illustrated in FIG. 11-14. The semi-compressed configuration may be defined by the tabs 482A 482B partially separated with the first end 422 and the second end 424 slightly overlapping. The retention band 484 may be made of any material capable of holding the strap 420 in the semi-compressed configuration. In one embodiment of the invention, the retention band 484 may be made of a biodegradable material that is capable of being flushed in the toilet bowl 14. The retention band 484 may also be made of a material that is capable of dissolving in the water when the band 484 and the trapping device 410 are placed in the water of the toilet bowl 14. The retention band 484 may be in the form and/or shape of a round band, a string, or any other shape capable of holding the trapping device 410 in a semi-compressed configuration.

Other compression systems may be utilized without departing from this invention. In another embodiment, the compression system 480 may include clasp. The clasp may attach or hold together the first end 422 and the second end 424 of the strap 420 while installing the trapping device 410 in the toilet bowl. Once the trapping device 410 is installed in the toilet bowl, the clasp may be released, opening the trapping device 410 to an open configuration, and thereby fitting and securing the trapping device in the bottom of the toilet bowl 14.

The size, resiliency, and flexibility of the strap 420 together with the compression system 480 provides the user with the ability to fit the strap 420 and trapping device 410 in to various sized toilet bowls 14, making the trapping device 410 adjustable and universal to many toilet bowls 14. The middle portion 426 may also include a polymer band or strip as described above.

Additionally, the strap 420 may include a front tab 444. The front tab 444 may be located on the front side of the first end 422 or second end 424 and may protrude from the strap 420 perpendicularly. When the trapping device 410 is installed in the toilet bowl 14, the front tab 444 may provide a stop for the trapping device 410 from going down the drain of the toilet bowl 14. When installed properly, the front tab 444 may be flush and or directly adjacent to the drain of the toilet bowl 14.

As shown in FIGS. 11-14, the plurality of hooks 460 are cut out of the strap 420 at various locations. In other embodiments of this invention, and as described above, the hooks 460 may be attached to the strap 420 at various locations as well. The hooks 460 are used to catch and retain the non-dispersing cloths, while allowing other materials to pass by. The hooks 460 may be located on the first end 422 of the strap 420, the second end 424 of the strap 420, or middle portion 426 of the strap 420 or any combination thereof. The number and location of the hooks 460 may vary as was described above in the various other embodiments. Additionally, the angle of the hooks 460 may vary as was described above in the various other embodiments. The number, location, and angle of the hooks 460 can vary without departing from at least some examples of this invention.

The hooks 460 may be made of different materials without departing from the scope of the present invention. The hook material should be rigid and inflexible. The hook material should be able to remain substantially in position during toilet bowl cleaning, and if moved from position, return to substantially the same position after the cleaning Additionally, the hook material should be a non-corrosive material so that the hooks 460 do not rust in the wet environment. Also, the hooks 460 may be sharp, such as sharp enough to catch the non-dispersing cloths, while being able to break or cut through the toilet paper and waste in the toilet 14. Additionally, barbed hooks 460 may be used without departing from at least some examples of the invention. The barbed hooks 460 may have a "T" barb to catch the non-dispersing cloths.

Figure 14A:
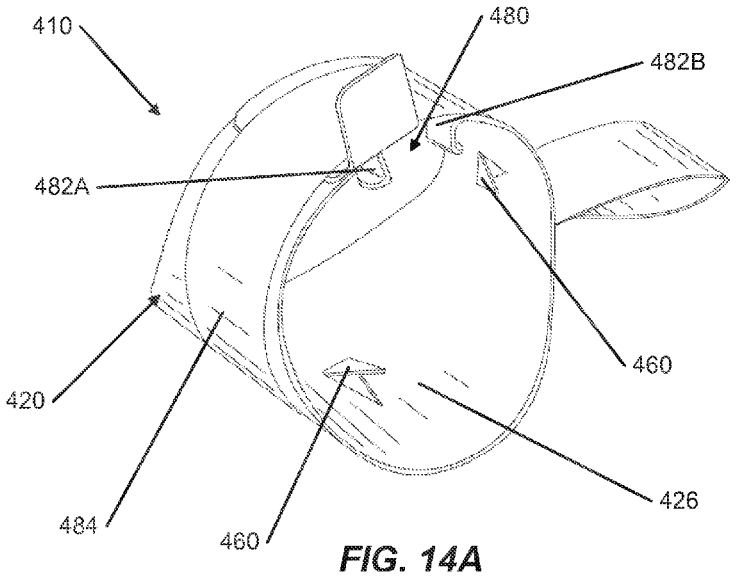
FIGS. 14A through 14F illustrate the installation process of the trapping device from FIG. 11 in accordance with aspects of this invention.

FIGS. 14A through 14F illustrate an example installation of the trapping device 410 in a toilet 14. The trapping device 410, as described above, may be installed in a toilet 14 by a user. To install the trapping device 410, the user may first ensure the trapping device 410 is prepared for installation, as shown in FIG. 14A. To prepare the trapping device 410 for installation, the user must first ensure the retention band 484 is securely around the trapping device 410. The trapping device 410 may include the retention band 484 already in place on the trapping device 410 when the trapping device 410 is purchased by a user. However, in the instance when the trapping device 410 is removed to be cleaned, etc. and then replaced into the toilet 14, the trapping device 410 will not have the retention band 484 in place. As is illustrated in FIG. 14A, the strap 420 of the trapping device 410 is expanded and held together by the retention band 484.

Figure 14B:
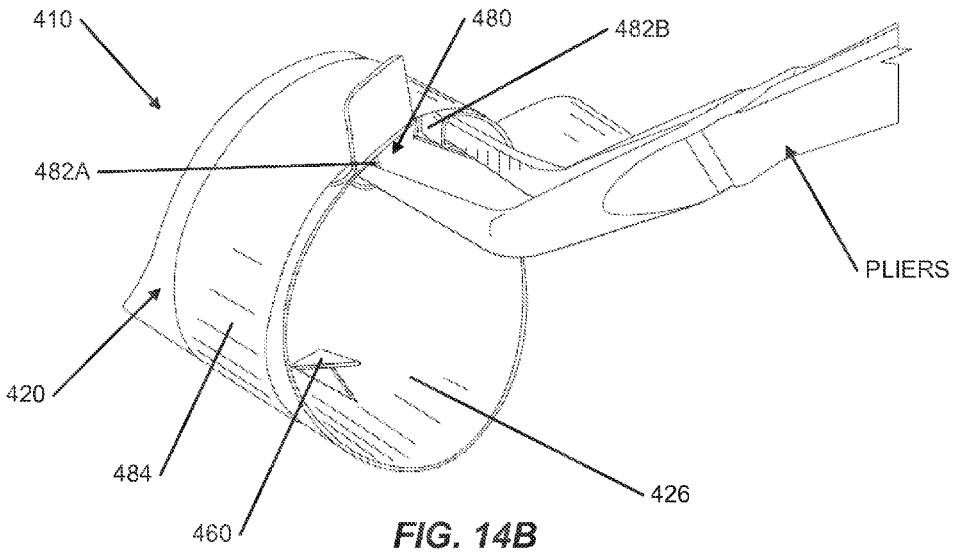

FIG. 14B illustrates the use of a tool, and as shown in these illustrations, a needle-nose pliers. Various other tools may be used to perform these functions without departing from this invention. Additionally, as was discussed above, many different compression devices 480 may be utilized, wherein a tool or external device may not be required to release the strap into the toilet bowl 14 and toilet bowl trapway 12. As illustrated in FIG. 14B, the needle-nose pliers engage the compression system 480 and the tabs 482A and 482B. Additionally, as illustrated in FIG. 14B, the tabs 482A and 482B each may have an additional tab to help the pliers hold onto and engage the tabs 482A and 482B without releasing them or dropping them.

Figure 14C:
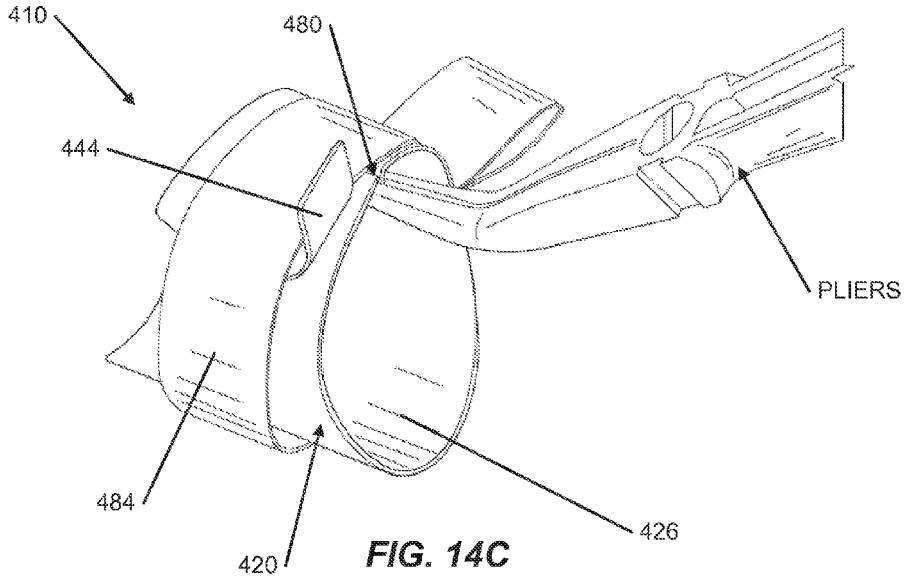
Figure 14D:
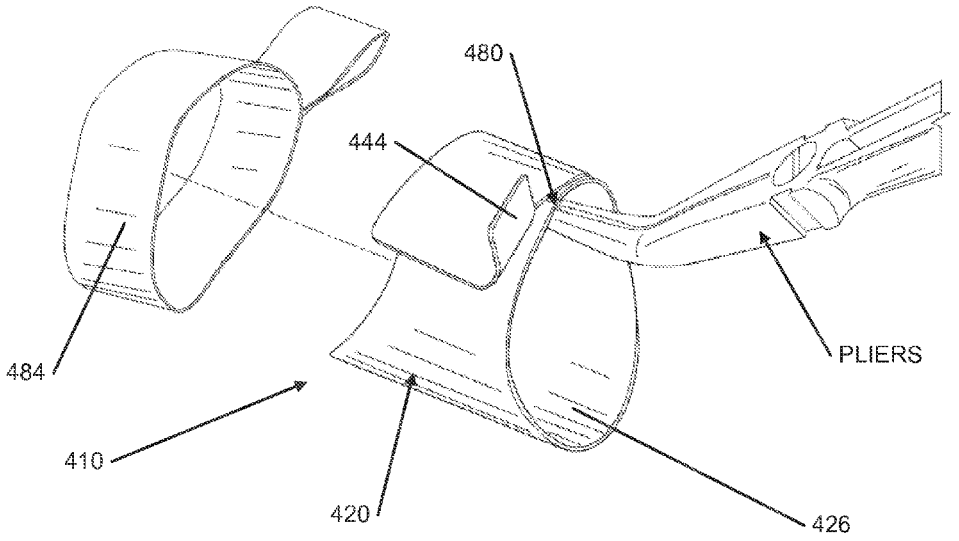

FIG. 14C illustrates the compression of the trapping device 410 and the strap 420 within the retention band 484. As is illustrated in FIG. 14C, the pliers may compress the strap 420 by pulling together the tabs 482A and 482B. By pulling together the tabs 482A and 482B, the strap 420 compresses thereby separating from the retention band 484 and allowing the removal of the retention band 484 from the trapping device 410. FIG. 14D illustrates the removal of the retention band 484 from the trapping device 410. With the trapping device 410 in the compressed configuration, the retention band 484 may be released from the trapping device 410 by sliding the retention band 484 off the strap 420. Additionally, the retention band 484 may be cut, torn, dissolved, from the trapping device, to include various other methods of removing the retention band 484 from the trapping device 410.

Figure 14E:
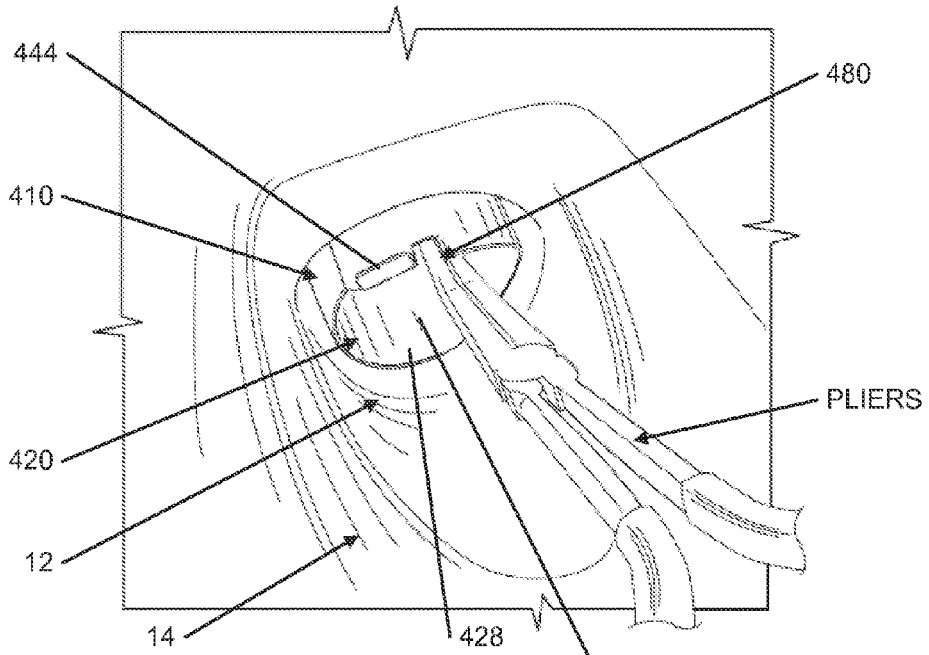
Figure 14F:
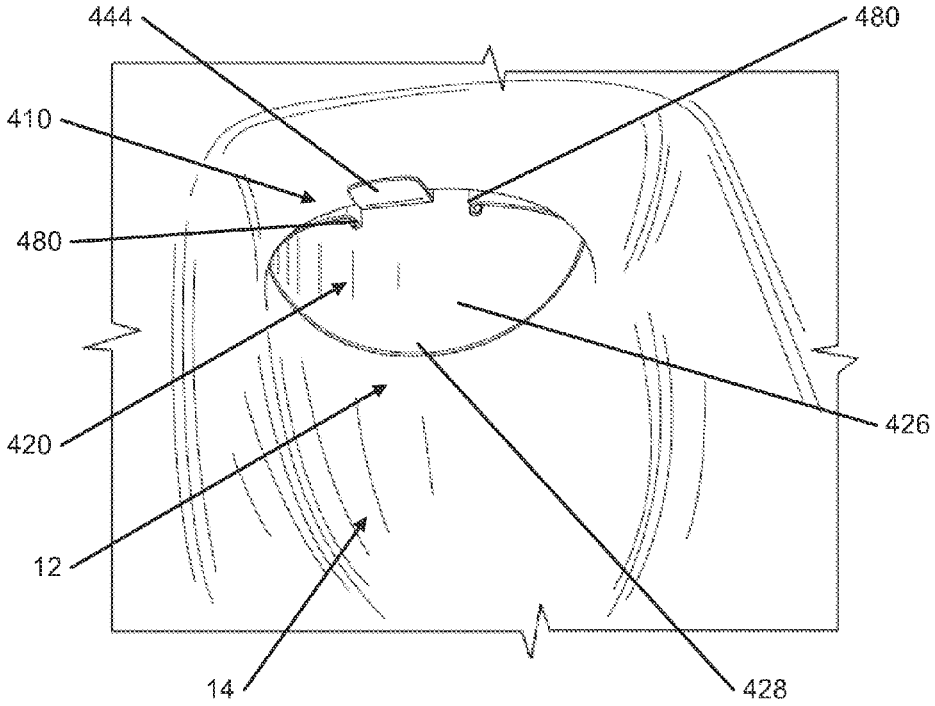

As illustrated in FIGS. 14E and 14F, the user may then install the trapping device 410 into the toilet bowl trapway 12. To install the trapping device 410 into the toilet bowl trapway 12, using the pliers or other tool, the user may first set the trapping device 410 at an angle with the front tab 444 on the top side of the trapping device. Still using the pliers, the user may then slide the trailing edge 430 of the middle portion 426 of the strap 420 into the bottom of the toilet bowl trapway 12. Once the trapping device 410 is set in the correct location in the toilet bowl trapway 12 of the toilet bowl 14, the user may release the pliers from the tabs 482A and 482B, thereby releasing the strap 420. The strap 420 will then expand into the toilet bowl trapway 12 to the correct size and shape. As was described above, other compression systems 480 may be utilized with this invention. For example, a clasp system or an automatic or mechanical release system may be utilized that releases the strap 420 to expand once the trapping device 410 is set and installed in the toilet bowl 14.

With the trapping device 410 installed in the toilet bowl 14, the front tab 444 may be seated against the front portion of the top side of the toilet bowl trapway 12. With the front tab 444 seated in this location on the toilet bowl trapway 12, the trapping device 410 is prevented from being pushed into the drain during normal toilet bowl operations, such as flushing, and normal toilet bowl cleaning. Additionally, the shape of the middle portion 426 of the strap 420, the general football shape, helps prevent the trapping device 410 from being pushed down the drain during normal toilet bowl operations, such as flushing, and normal toilet bowl cleaning. The combination of the front tab 444 and the shape of the middle portion 426 help to keep the trapping device 410 in the proper location throughout the entire flushing process, with water exiting through the drain and water flowing upward after the flush to fill the toilet bowl 14. As illustrated in FIGS. 14E and 14F, the leading edge 428 of the strap 420 may be the only part of the trapping device 410 that the user can see when the trapping device 410 is installed in the toilet bowl 14.

Once installed, the trapping device 410 can also be removed from the toilet bowl 14. The user may need to use pliers or a similar tool to remove the trapping device 410 from the toilet bowl trapway 12 because of the close fit and the front tab 444 engagement with the top of the toilet bowl trapway 12. Additionally, the trapping device 410 may be semi-permanently installed in the toilet bowl 414. This semi-permanent installation may be accomplished by using epoxy or cement or some other glue material without departing from the scope of this invention.

Figure 11:
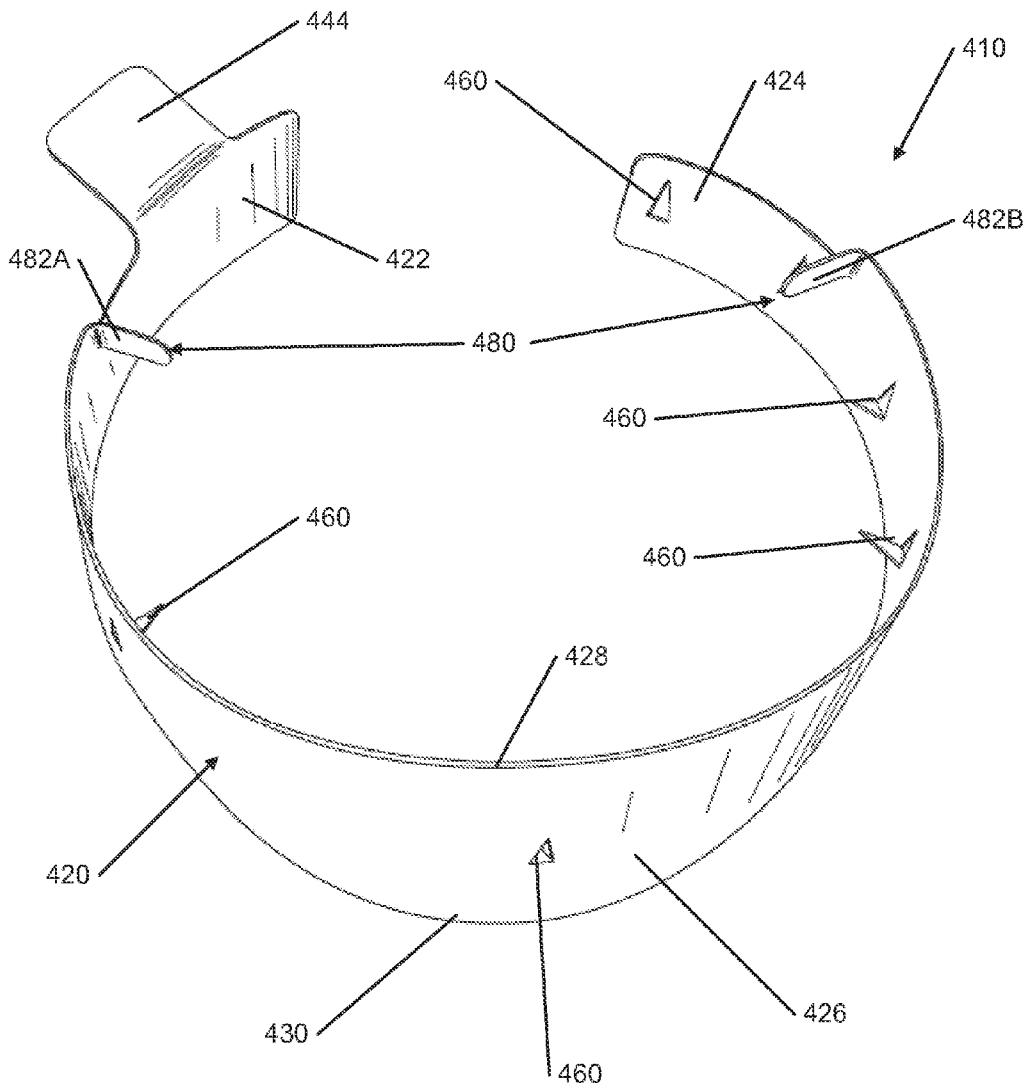
FIG. 11 illustrates a perspective view of another trapping device in expanded configuration for use in a toilet bowl in accordance with aspects of this invention.
Figure 12:
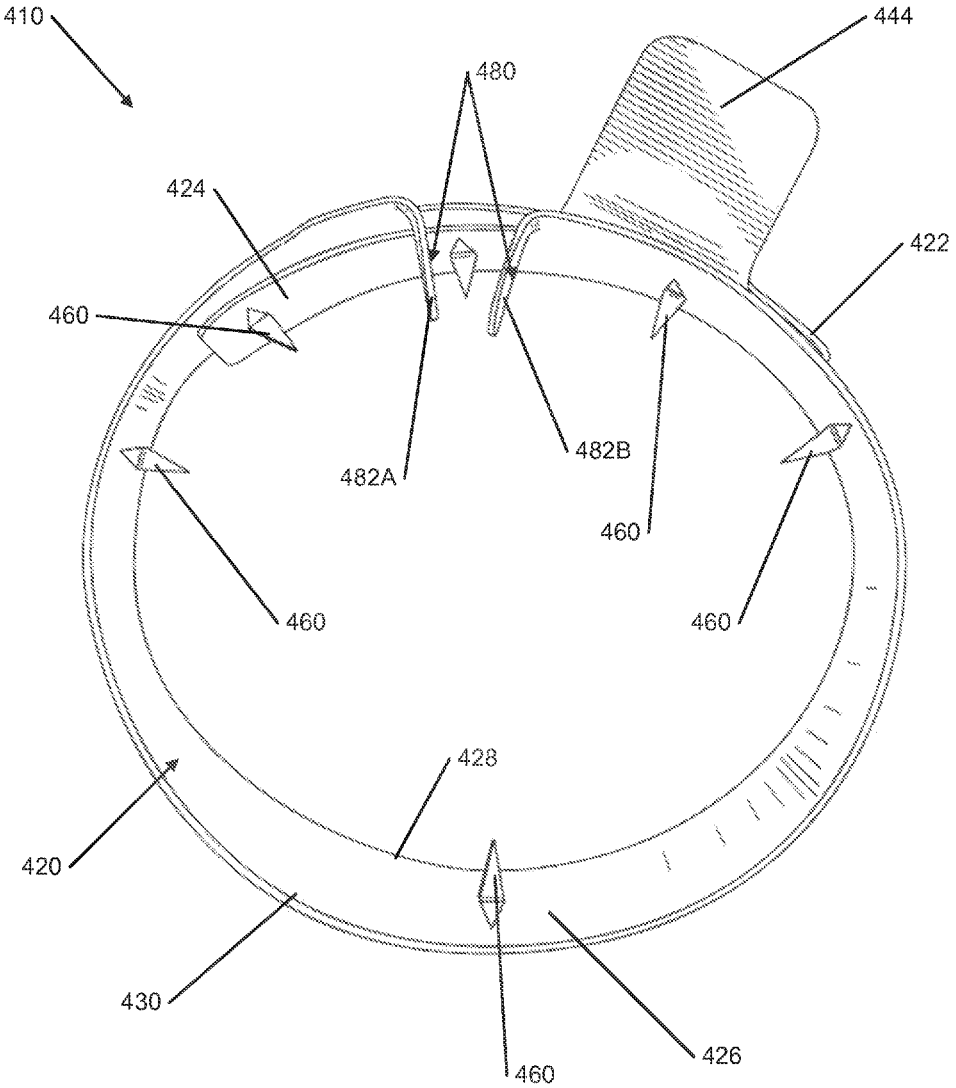
FIG. 12 illustrates the trapping device from FIG. 11 in compressed configuration in accordance with aspects of this invention.
Figure 13:
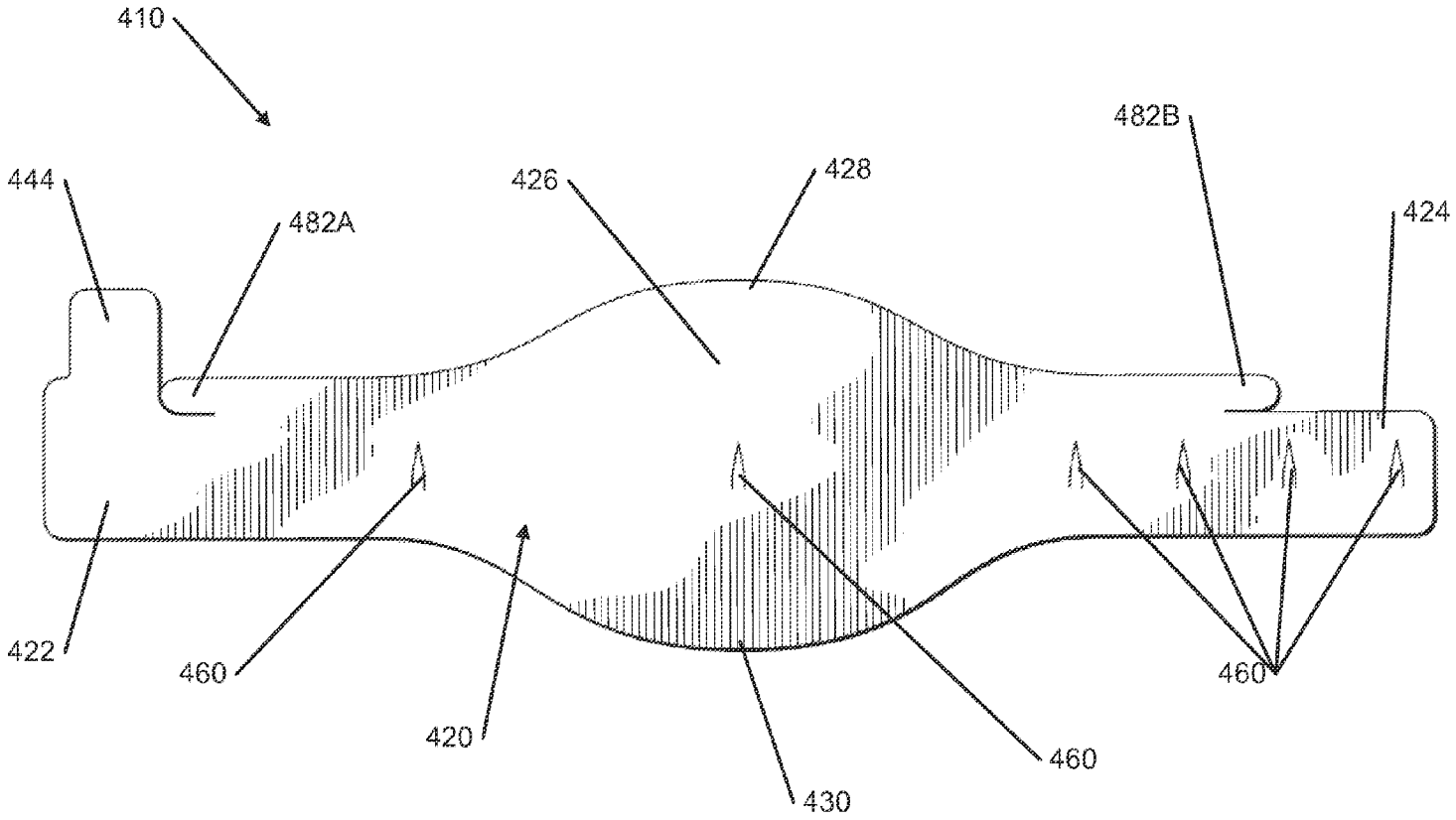
FIG. 13 illustrates the trapping device from FIG. 11 in blank manufactured configuration in accordance with aspects of this invention.
Figure 15:
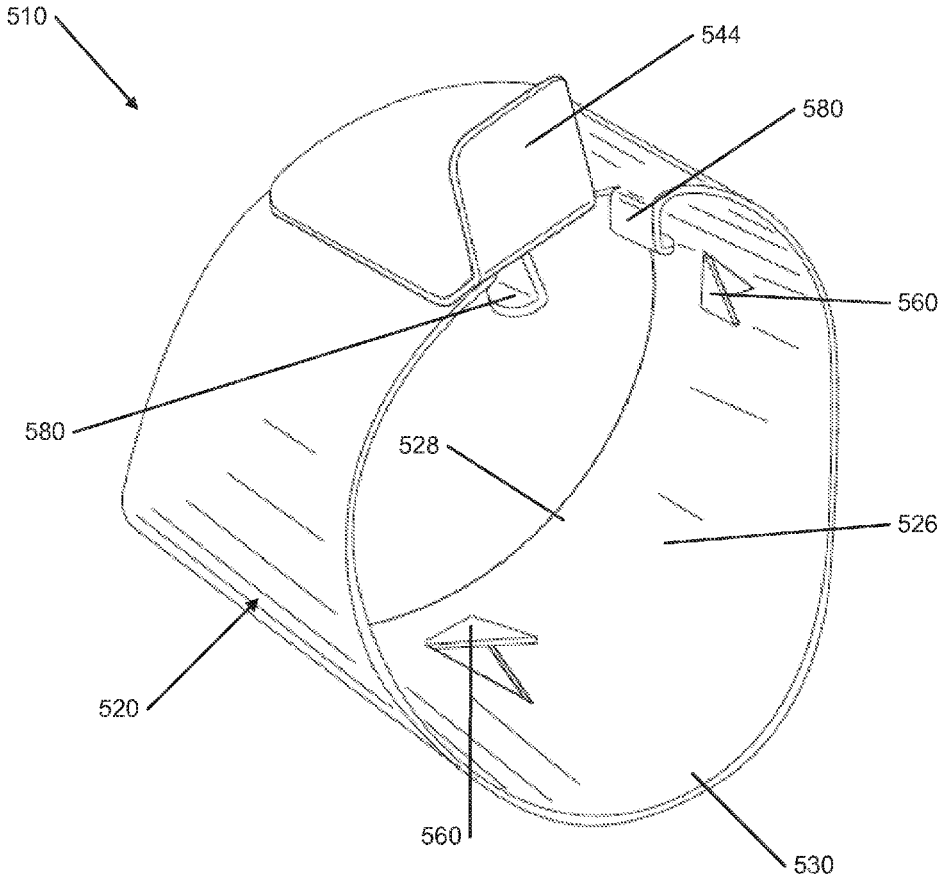
FIG. 15 illustrates another trapping device in accordance with aspects of this invention.
Figure 16:
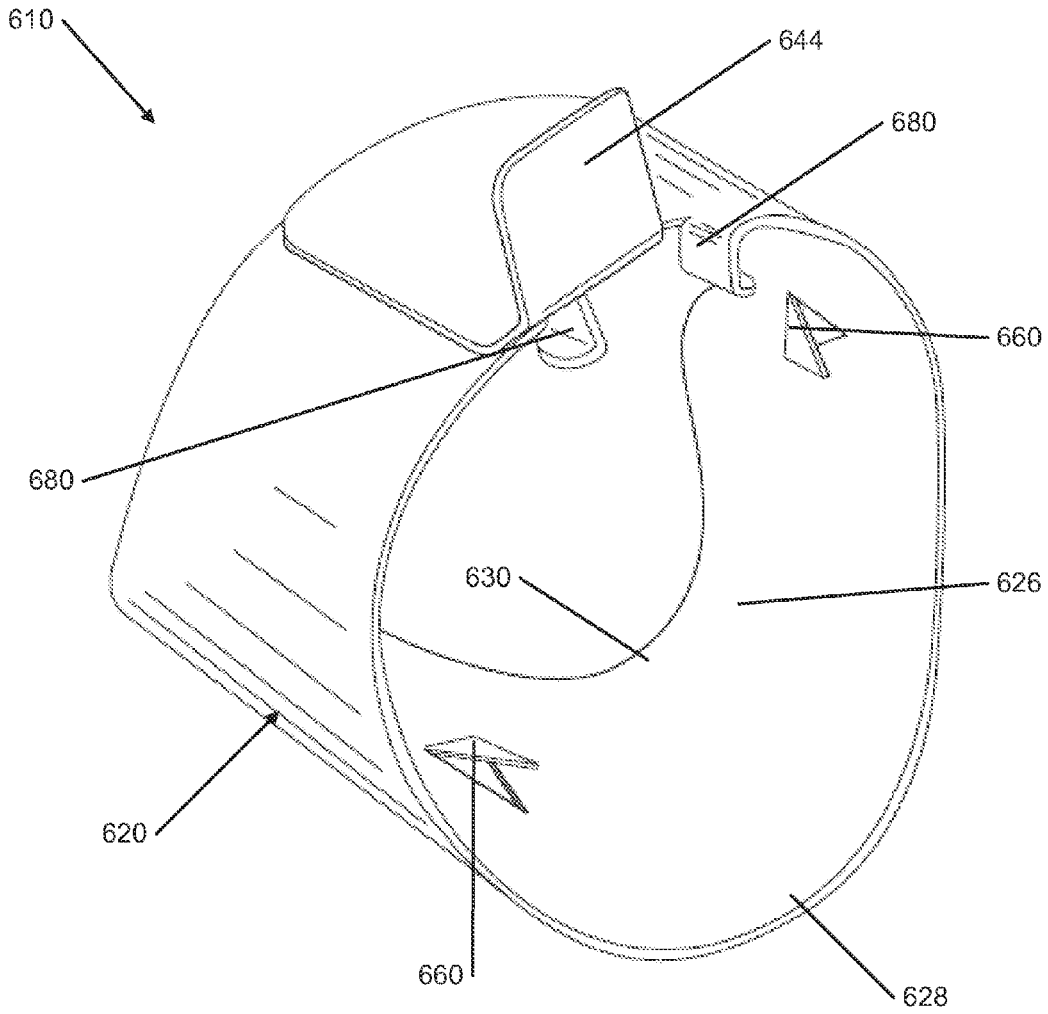
FIG. 16 illustrates another trapping device for use in a jet-assist toilet bowl in accordance with aspects of this invention.

FIGS. 15 and 16 illustrate example combinations according to this invention similar to that described above in conjunction with FIGS. 11-13 (the same or similar reference numbers are used in FIGS. 15 and 16 as those used in FIGS. 11 through 13 to denote the same or similar parts). FIG. 15 illustrates a trapping device 510 wherein the trailing edge 528 is straight instead of the curved edges as illustrated in FIG. 11. FIG. 16 illustrates a trapping device 610 for a toilet bowl with a "jet-assist" housing near the toilet bowl trapway. The jet-assist propels water into the trapway to aid in clearing the toilet bowl. As FIG. 16 illustrates, the jet-assist trapping device 610 may have a section from the middle portion 626 on the trailing edge 630 that is cut away to accommodate the jet-assist housing. Similar to the trapping device 610 described above, the hooks 660 may be located approximately an inch apart. The number, location, and angle of the hooks 660 on the strap 620 can vary without departing from at least some examples of this invention.

CONCLUSION

The present invention is disclosed above and in the accompanying drawings with reference to a variety of examples. The purpose served by the disclosure, however, is to provide an example of the various features and concepts related to the invention, not to limit the scope of the invention. One skilled in the relevant art will recognize that numerous variations and modifications may be made to the aspects described above without departing from the scope of the present invention, as defined by the appended claims.

We claim:

1. A trapping device for trapping non-dispersing cloths in a toilet bowl comprising:

a strap having a first end, a second end, and a middle portion, wherein the first end includes a first tab extending perpendicular to the strap and the second end includes a second tab extending perpendicular to the strap, and the middle portion is rounded;

a plurality of hooks extending from an inner wall of the strap; and a retention band that extends around the periphery of the strap.

2. The trapping device according to claim 1, wherein the middle portion includes a polymer band located along a leading edge of a side of the middle portion.

3. The trapping device according to claim 2, wherein the trapping device is installed in a trapway of the toilet bowl and the polymer band engages the bottom of the trapway of the toilet bowl.

4. The trapping device according to claim 1, wherein the first end includes a front tab that prevents the trapping device from being pushed down the toilet bowl.

5. The trapping device according to claim 1, wherein the strap material is stainless steel.

6. The trapping device according to claim 1, wherein the strap material is high density polyethylene.

7. The trapping device according to claim 1, wherein the retention band is made of a biodegradable material capable of being flushed in a toilet.

8. The trapping device according to claim 1, wherein the retention band is made of a material that dissolves in water.

9. The trapping device according to claim 1, wherein the plurality of hooks comprises at least five hooks.

10. The trapping device according to claim 1, wherein the retention band holds the strap in a semi-compressed configuration defined by the first tab and the second tab partially separated with the first end and the second end overlapping.

11. The trapping device according to claim 1, wherein the strap is made of a strap material that is resilient to bend and spring back to its previous shape.

12. A trapping device for trapping non-dispersing cloths in a toilet bowl, the trapping device comprising:

a strap having a first end, a second end, and a middle portion, wherein the middle portion is rounded;

a plurality of hooks extending from an inner wall of the strap; and a compression system configured to hold the strap in a rounded semi-compressed configuration and then release the strap to a rounded uncompressed configuration when installed in a toilet bowl such that the strap fits tightly within the toilet bowl, wherein the compression system further includes a retention band that extends around the periphery of the strap, wherein the retention band is made of a biodegradable material capable of being flushed in a toilet.

13. The trapping device according to claim 12, wherein the compression system includes a first tab on the first end and a second tab on the second end, wherein the first tab and the second tab are configured to be held together in a rounded compressed configuration by a tool, and further wherein the first tab and second tab are configured to be separated in the rounded semi-compressed configuration.

14. The trapping device according to claim 13, wherein retention band holds the strap in a semi-compressed configuration defined by the first tab and the second tab partially separated with the first end and second end overlapping.

15. The trapping device according to claim 12, wherein the retention band is made of a material that dissolves in water.

16. The trapping device according to claim 13, wherein the first tab extends perpendicular from the first end of the strap and the second tab extends perpendicular from the second end of the strap.

17. The trapping device according to claim 12, wherein the compression system includes a clasp system that holds the first end and the second end together in a rounded compressed configuration and releases the first end and second end when installed in the toilet bowl.

18. The trapping device according to claim 12, wherein the plurality of hooks extend at an angle between approximately 45-60 degrees from the strap.

19. A method for trapping non-dispersing cloths in a toilet bowl, the method comprising:

preparing a trapping device for installation, the trapping device comprising:

a strap having a first end, a second end, and a middle portion, wherein the first end includes a first tab extending perpendicular to the strap and the second end includes a second tab extending perpendicular to the strap, and the middle portion is rounded, a plurality of hooks extending from an inner wall of the strap, and a retention band that extends around the periphery of the strap, wherein preparing the trapping device for installation ensures that the retention band is engaged with the strap and installed around the strap of the trapping device;

engaging the first tab and the second tab with a tool;

compressing the first tab and the second tab with the tool, wherein the compressing disengages the retention band from the strap of the trapping device;

removing the retention band from the strap of the trapping device;

using the tool, setting the trapping device into the toilet bowl; and releasing the tabs from the tool, thereby expanding the strap of the trapping device in the toilet bowl to a rounded uncompressed configuration such that the strap fits tightly within the toilet bowl.

20. The method according to claim 19, further including the steps of:

engaging the first tab and the second tab with the tool;

compressing the first tab and the second tab with the tool, wherein the compressing disengages the trapping device from the toilet bowl, thereby allowing the trapping device to be removed from the toilet bowl; and removing the trapping device from the toilet bowl with the tool.

21. The method according to claim 20, wherein the retention band holds the strap in a semi-compressed configuration defined by the first tab and the second tab partially separated with the first end and second end overlapping.

* * * * *